US011931621B2

(12) United States Patent
Nascimento

(10) Patent No.: US 11,931,621 B2
(45) Date of Patent: Mar. 19, 2024

(54) SYSTEMS AND METHODS FOR TREADMILL DRIFT AVOIDANCE

(71) Applicant: iFIT Inc., Logan, UT (US)

(72) Inventor: Chris Nascimento, Millville, UT (US)

(73) Assignee: iFIT Inc., Logan, UT (US)

( * ) Notice: Subject to any disclaimer, the term of this patent is extended or adjusted under 35 U.S.C. 154(b) by 300 days.

(21) Appl. No.: 17/204,704

(22) Filed: Mar. 17, 2021

(65) Prior Publication Data

US 2021/0291013 A1 Sep. 23, 2021

Related U.S. Application Data

(60) Provisional application No. 62/991,378, filed on Mar. 18, 2020.

(51) Int. Cl.
*A63B 22/02* (2006.01)
*A63B 71/06* (2006.01)

(52) U.S. Cl.
CPC ..... *A63B 22/02* (2013.01); *A63B 71/0622* (2013.01); *A63B 2220/13* (2013.01); *A63B 2220/803* (2013.01); *A63B 2220/833* (2013.01)

(58) Field of Classification Search
CPC ..... A63B 71/0622; A63B 2071/0627; A63B 2220/13; A63B 2220/803; A63B 2220/833; A63B 2220/805; A63B 22/02; A63B 2071/0655; A63B 2071/065; B60W 50/14; B60W 2050/143; B60W 2050/146; A63F 13/537; A63F 2300/303; A63F 2300/8076
See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang |
| 4,023,795 | A | 5/1977 | Pauls |
| 4,300,760 | A | 11/1981 | Bobroff |
| D286,311 | S | 10/1986 | Martinell |
| 4,681,318 | A | 7/1987 | Lay |
| 4,684,126 | A | 8/1987 | Dalebout |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |

(Continued)

FOREIGN PATENT DOCUMENTS

| | | | |
|---|---|---|---|
| CN | 107715431 A | * | 2/2018 |
| KR | 20090095128 | | 9/2009 |

(Continued)

OTHER PUBLICATIONS

English translation of CN107715431A Liuhua (Year: 2018).*

(Continued)

*Primary Examiner* — Megan Anderson
*Assistant Examiner* — Sara K. Conway
(74) *Attorney, Agent, or Firm* — RAY QUINNEY & NEBEKER P.C.; Paul N. Taylor

(57) ABSTRACT

A treadmill includes sensors on a console at the front of the treadmill. The sensors sense the lateral position of a user relative to the edge of the exercise deck and/or the exercise belt. If the user is close to the edge of the exercise deck, then an alert is displayed on the console.

19 Claims, 12 Drawing Sheets

(56) References Cited

U.S. PATENT DOCUMENTS

| | | | |
|---|---|---|---|
| 4,844,451 | A | 7/1989 | Bersonnet |
| 4,850,585 | A | 7/1989 | Dalebout |
| D304,849 | S | 11/1989 | Watterson |
| 4,880,225 | A | 11/1989 | Lucas |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout |
| D307,614 | S | 5/1990 | Bingham |
| D307,615 | S | 5/1990 | Bingham |
| 4,921,242 | A | 5/1990 | Watterson |
| 4,932,650 | A | 6/1990 | Bingham |
| D309,167 | S | 7/1990 | Griffin |
| D309,485 | S | 7/1990 | Bingham |
| 4,938,478 | A | 7/1990 | Lay |
| D310,253 | S | 8/1990 | Bersonnet |
| 4,955,599 | A | 9/1990 | Bersonnet |
| 4,971,316 | A | 11/1990 | Dalebout |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout |
| D315,765 | S | 3/1991 | Measom |
| 4,998,725 | A | 3/1991 | Watterson |
| 5,000,442 | A | 3/1991 | Dalebout |
| 5,000,443 | A | 3/1991 | Dalebout |
| 5,000,444 | A | 3/1991 | Dalebout |
| D316,124 | S | 4/1991 | Dalebout |
| 5,013,033 | A | 5/1991 | Watterson |
| 5,014,980 | A | 5/1991 | Bersonnet |
| 5,016,871 | A | 5/1991 | Dalebout |
| D318,085 | S | 7/1991 | Jacobson |
| D318,086 | S | 7/1991 | Bingham |
| D318,699 | S | 7/1991 | Jacobson |
| 5,029,801 | A | 7/1991 | Dalebout |
| 5,034,576 | A | 7/1991 | Dalebout |
| 5,058,881 | A | 10/1991 | Measom |
| 5,058,882 | A | 10/1991 | Dalebout |
| D321,388 | S | 11/1991 | Dalebout |
| 5,062,626 | A | 11/1991 | Dalebout |
| 5,062,627 | A | 11/1991 | Bingham |
| 5,062,632 | A | 11/1991 | Dalebout |
| 5,062,633 | A | 11/1991 | Engel |
| 5,067,710 | A | 11/1991 | Watterson |
| 5,072,929 | A | 12/1991 | Peterson |
| D323,009 | S | 1/1992 | Dalebout |
| D323,198 | S | 1/1992 | Dalebout |
| D323,199 | S | 1/1992 | Dalebout |
| D323,863 | S | 2/1992 | Watterson |
| 5,088,729 | A | 2/1992 | Dalebout |
| 5,090,694 | A | 2/1992 | Pauls |
| 5,102,380 | A | 4/1992 | Jacobson |
| 5,104,120 | A | 4/1992 | Watterson |
| 5,108,093 | A | 4/1992 | Watterson |
| D326,491 | S | 5/1992 | Dalebout |
| 5,122,105 | A | 6/1992 | Engel |
| 5,135,216 | A | 8/1992 | Bingham |
| 5,147,265 | A | 9/1992 | Pauls |
| 5,149,084 | A | 9/1992 | Dalebout |
| 5,149,312 | A | 9/1992 | Croft et al. |
| 5,171,196 | A | 12/1992 | Lynch |
| D332,347 | S | 1/1993 | Raadt |
| 5,190,505 | A | 3/1993 | Dalebout |
| 5,192,255 | A | 3/1993 | Dalebout |
| 5,195,937 | A | 3/1993 | Engel |
| 5,203,826 | A | 4/1993 | Dalebout |
| D335,511 | S | 5/1993 | Engel |
| D335,905 | S | 5/1993 | Cutter |
| D336,498 | S | 6/1993 | Engel |
| 5,217,487 | A | 6/1993 | Engel |
| D337,361 | S | 7/1993 | Engel |
| D337,666 | S | 7/1993 | Peterson |
| D337,799 | S | 7/1993 | Cutter |
| 5,226,866 | A | 7/1993 | Engel |
| 5,244,446 | A | 9/1993 | Engel |
| 5,247,853 | A | 9/1993 | Dalebout |
| 5,259,611 | A | 11/1993 | Dalebout |
| D342,106 | S | 12/1993 | Campbell |
| 5,279,528 | A | 1/1994 | Dalebout |
| D344,112 | S | 2/1994 | Smith |
| D344,557 | S | 2/1994 | Ashby |
| 5,282,776 | A | 2/1994 | Dalebout |
| 5,295,931 | A | 3/1994 | Dreibelbis |
| 5,302,161 | A | 4/1994 | Loubert |
| D347,251 | S | 5/1994 | Dreibelbis |
| 5,316,534 | A | 5/1994 | Dalebout |
| D348,493 | S | 7/1994 | Ashby |
| D348,494 | S | 7/1994 | Ashby |
| 5,328,164 | A | 7/1994 | Soga |
| D349,931 | S | 8/1994 | Bostic |
| 5,336,142 | A | 8/1994 | Dalebout |
| 5,344,376 | A | 9/1994 | Bostic |
| D351,202 | S | 10/1994 | Bingham |
| D351,435 | S | 10/1994 | Peterson |
| D351,633 | S | 10/1994 | Bingham |
| D352,534 | S | 11/1994 | Dreibelbis |
| D353,422 | S | 12/1994 | Bostic |
| 5,372,559 | A | 12/1994 | Dalebout |
| 5,374,228 | A | 12/1994 | Buisman |
| 5,382,221 | A | 1/1995 | Hsu |
| 5,387,168 | A | 2/1995 | Bostic |
| 5,393,690 | A | 2/1995 | Fu |
| D356,128 | S | 3/1995 | Smith |
| 5,409,435 | A | 4/1995 | Daniels |
| 5,429,563 | A | 7/1995 | Engel |
| 5,431,612 | A | 7/1995 | Holden |
| D360,915 | S | 8/1995 | Bostic |
| 5,468,205 | A | 11/1995 | McFall |
| 5,489,249 | A | 2/1996 | Brewer |
| 5,492,517 | A | 2/1996 | Bostic |
| D367,689 | S | 3/1996 | Wilkinson |
| 5,511,740 | A | 4/1996 | Loubert |
| 5,512,025 | A | 4/1996 | Dalebout |
| D370,949 | S | 6/1996 | Furner |
| D371,176 | S | 6/1996 | Furner |
| 5,527,245 | A | 6/1996 | Dalebout |
| 5,529,553 | A | 6/1996 | Finlayson |
| 5,540,429 | A | 7/1996 | Dalebout |
| 5,549,533 | A | 8/1996 | Olson |
| 5,554,085 | A | 9/1996 | Dalebout |
| 5,569,128 | A | 10/1996 | Dalebout |
| 5,591,105 | A | 1/1997 | Dalebout |
| 5,591,106 | A | 1/1997 | Dalebout |
| 5,595,556 | A | 1/1997 | Dalebout |
| 5,607,375 | A | 3/1997 | Dalebout |
| 5,611,539 | A | 3/1997 | Watterson |
| 5,622,527 | A | 4/1997 | Watterson |
| 5,626,538 | A | 5/1997 | Dalebout |
| 5,626,542 | A | 5/1997 | Dalebout |
| D380,024 | S | 6/1997 | Novak |
| 5,637,059 | A | 6/1997 | Dalebout |
| D380,509 | S | 7/1997 | Wilkinson |
| 5,643,153 | A | 7/1997 | Nylen |
| 5,645,509 | A | 7/1997 | Brewer |
| D384,118 | S | 9/1997 | Deblauw |
| 5,662,557 | A | 9/1997 | Watterson |
| 5,669,857 | A | 9/1997 | Watterson |
| 5,672,140 | A | 9/1997 | Watterson |
| 5,674,156 | A | 10/1997 | Watterson |
| 5,674,453 | A | 10/1997 | Watterson |
| 5,676,624 | A | 10/1997 | Watterson |
| 5,683,331 | A | 11/1997 | Dalebout |
| 5,683,332 | A | 11/1997 | Watterson |
| D387,825 | S | 12/1997 | Fleck |
| 5,695,433 | A | 12/1997 | Buisman |
| 5,695,434 | A | 12/1997 | Dalebout |
| 5,695,435 | A | 12/1997 | Dalebout |
| 5,702,325 | A | 12/1997 | Watterson |
| 5,704,879 | A | 1/1998 | Watterson |
| 5,718,657 | A | 2/1998 | Dalebout et al. |
| 5,720,200 | A | 2/1998 | Anderson |
| 5,720,698 | A | 2/1998 | Dalebout |
| D392,006 | S | 3/1998 | Dalebout |
| 5,722,922 | A | 3/1998 | Watterson |

(56) References Cited

U.S. PATENT DOCUMENTS 5,733,229 A 3/1998 Dalebout
5,743,833 A 4/1998 Watterson
5,762,584 A 6/1998 Daniels
5,762,587 A 6/1998 Dalebout
5,772,560 A 6/1998 Watterson
5,810,698 A 9/1998 Hullett
5,827,155 A 10/1998 Jensen
5,830,114 A 11/1998 Halfen
5,860,893 A 1/1999 Watterson
5,860,894 A 1/1999 Dalebout
5,899,834 A 5/1999 Dalebout
D412,953 S 8/1999 Armstrong
D413,948 S 9/1999 Dalebout
5,951,441 A 9/1999 Dalebout
5,951,448 A 9/1999 Bolland
D416,596 S 11/1999 Armstrong
6,003,166 A 12/1999 Hald
6,019,710 A 2/2000 Dalebout
6,027,429 A 2/2000 Daniels
6,033,347 A 3/2000 Dalebout et al.
D425,940 S 5/2000 Halfen
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout
6,312,363 B1 11/2001 Watterson
D452,338 S 12/2001 Dalebout
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris
6,422,980 B1 7/2002 Simonson
6,447,424 B1 9/2002 Ashby et al.
6,458,060 B1 10/2002 Watterson
6,458,061 B2 10/2002 Simonson
6,471,622 B1 10/2002 Hammer
6,563,225 B2 5/2003 Soga
6,601,016 B1 7/2003 Brown
6,623,140 B2 9/2003 Watterson
6,626,799 B2 9/2003 Watterson
6,652,424 B2 11/2003 Dalebout
6,685,607 B1 2/2004 Olson
6,695,581 B2 2/2004 Wasson
6,701,271 B2 3/2004 Willner
6,702,719 B1 3/2004 Brown
6,712,740 B2 3/2004 Simonson
6,730,002 B2 5/2004 Hald
6,743,153 B2 6/2004 Watterson
6,746,371 B1 6/2004 Brown
6,749,537 B1 6/2004 Hickman
6,749,541 B1 * 6/2004 Martin ..... A63B 22/0292 482/54
6,761,667 B1 7/2004 Cutler et al.
6,770,015 B2 8/2004 Simonson
6,786,852 B2 9/2004 Watterson
6,808,472 B1 10/2004 Hickman
6,821,230 B2 11/2004 Dalebout
6,830,540 B2 12/2004 Watterson
6,863,641 B1 3/2005 Brown
6,866,613 B1 3/2005 Brown
6,875,160 B2 4/2005 Watterson
D507,311 S 7/2005 Butler
6,918,858 B2 7/2005 Watterson
6,921,351 B1 7/2005 Hickman
6,974,404 B1 12/2005 Watterson
6,997,852 B2 2/2006 Watterson
7,025,713 B2 4/2006 Dalebout
D520,085 S 5/2006 Willardson
7,044,897 B2 5/2006 Myers
7,052,442 B2 5/2006 Watterson
7,060,006 B1 6/2006 Watterson
7,060,008 B2 6/2006 Watterson et al.
7,070,539 B2 7/2006 Brown
7,097,588 B2 8/2006 Watterson
D527,776 S 9/2006 Willardson
7,112,168 B2 9/2006 Dalebout et al.
7,128,693 B2 10/2006 Brown
7,166,062 B1 1/2007 Watterson
7,166,064 B2 1/2007 Watterson
7,169,087 B2 1/2007 Ercanbrack
7,169,093 B2 1/2007 Simonson
7,192,388 B2 3/2007 Dalebout
7,250,022 B2 7/2007 Dalebout
7,282,016 B2 10/2007 Simonson
7,285,075 B2 10/2007 Cutler
7,344,481 B2 3/2008 Watterson
7,377,882 B2 5/2008 Watterson
7,425,188 B2 9/2008 Ercanbrack
7,429,236 B2 9/2008 Dalebout
7,455,622 B2 11/2008 Watterson
7,482,050 B2 1/2009 Olson
D588,655 S 3/2009 Utykanski
7,510,509 B2 3/2009 Hickman
7,537,546 B2 5/2009 Watterson
7,537,549 B2 5/2009 Nelson
7,537,552 B2 5/2009 Dalebout
7,540,828 B2 6/2009 Watterson
7,549,947 B2 6/2009 Hickman
7,556,590 B2 7/2009 Watterson et al.
7,563,203 B2 7/2009 Dalebout
7,575,536 B1 8/2009 Hickman
7,601,105 B1 10/2009 Gipson, III
7,604,573 B2 10/2009 Dalebout
D604,373 S 11/2009 Dalebout
7,618,350 B2 11/2009 Dalebout
7,618,357 B2 11/2009 Dalebout
7,625,315 B2 12/2009 Hickman
7,625,321 B2 12/2009 Simonson
7,628,730 B1 12/2009 Watterson
7,628,737 B2 12/2009 Kowallis
7,637,847 B1 12/2009 Hickman
7,645,212 B2 1/2010 Ashby et al.
7,645,213 B2 1/2010 Watterson
7,658,698 B2 2/2010 Pacheco
7,674,205 B2 3/2010 Dalebout
7,713,171 B1 5/2010 Hickman
7,713,172 B2 5/2010 Watterson
7,713,180 B2 5/2010 Wickens
7,717,828 B2 5/2010 Simonson
7,736,279 B2 6/2010 Dalebout
7,740,563 B2 6/2010 Dalebout
7,749,144 B2 7/2010 Hammer
7,766,797 B2 8/2010 Dalebout
7,771,329 B2 8/2010 Dalebout
7,775,940 B2 8/2010 Dalebout
7,789,800 B1 9/2010 Watterson
7,798,946 B2 9/2010 Dalebout
7,815,550 B2 10/2010 Watterson
7,857,731 B2 12/2010 Hickman
7,862,475 B2 1/2011 Watterson
7,862,478 B2 1/2011 Watterson
7,862,483 B2 1/2011 Hendrickson
D635,207 S 3/2011 Dalebout
7,901,330 B2 3/2011 Dalebout
7,909,740 B2 3/2011 Dalebout
7,980,996 B2 7/2011 Hickman
7,981,000 B2 7/2011 Watterson
7,985,164 B2 7/2011 Ashby
8,029,415 B2 10/2011 Ashby et al.
8,033,960 B1 10/2011 Dalebout
D650,451 S 12/2011 Olson
D652,877 S 1/2012 Dalebout
8,152,702 B2 4/2012 Pacheco

(56) References Cited

U.S. PATENT DOCUMENTS

| | | | |
|---|---|---|---|
| D659,775 | S | 5/2012 | Olson |
| D659,777 | S | 5/2012 | Watterson |
| D660,383 | S | 5/2012 | Watterson |
| D664,613 | S | 7/2012 | Dalebout |
| 8,251,874 | B2 | 8/2012 | Ashby |
| 8,298,123 | B2 | 10/2012 | Hickman |
| 8,298,125 | B2 | 10/2012 | Colledge |
| D671,177 | S | 11/2012 | Sip |
| D671,178 | S | 11/2012 | Sip |
| D673,626 | S | 1/2013 | Olson |
| 8,690,735 | B2 | 4/2014 | Watterson |
| D707,763 | S | 6/2014 | Cutler |
| 8,740,753 | B2 | 6/2014 | Olson |
| 8,758,201 | B2 | 6/2014 | Ashby |
| 8,771,153 | B2 | 7/2014 | Dalebout |
| 8,784,270 | B2 | 7/2014 | Watterson |
| 8,808,148 | B2 | 8/2014 | Watterson |
| 8,814,762 | B2 | 8/2014 | Butler |
| D712,493 | S | 9/2014 | Ercanbrack |
| 8,840,075 | B2 | 9/2014 | Olson |
| 8,845,493 | B2 | 9/2014 | Watterson |
| 8,870,726 | B2 | 10/2014 | Watterson |
| 8,876,668 | B2 | 11/2014 | Hendrickson |
| 8,894,549 | B2 | 11/2014 | Colledge |
| 8,894,555 | B2 | 11/2014 | Olson |
| 8,911,330 | B2 | 12/2014 | Watterson |
| 8,920,288 | B2 | 12/2014 | Dalebout |
| 8,986,165 | B2 | 3/2015 | Ashby |
| 8,992,364 | B2 | 3/2015 | Law |
| 8,992,387 | B2 | 3/2015 | Watterson |
| D726,476 | S | 4/2015 | Ercanbrack |
| 9,028,368 | B2 | 5/2015 | Ashby |
| 9,028,370 | B2 | 5/2015 | Watterson |
| 9,039,578 | B2 | 5/2015 | Dalebout |
| D731,011 | S | 6/2015 | Buchanan |
| 9,072,930 | B2 | 7/2015 | Ashby |
| 9,119,983 | B2 | 9/2015 | Rhea |
| 9,123,317 | B2 | 9/2015 | Watterson |
| 9,126,071 | B2 | 9/2015 | Smith |
| 9,126,072 | B2 | 9/2015 | Watterson |
| 9,138,615 | B2 | 9/2015 | Olson |
| 9,142,139 | B2 | 9/2015 | Watterson |
| 9,144,703 | B2 | 9/2015 | Dalebout |
| 9,149,683 | B2 | 9/2015 | Watterson |
| 9,186,535 | B2 | 11/2015 | Ercanbrack |
| 9,186,549 | B2 | 11/2015 | Watterson |
| 9,254,409 | B2 | 2/2016 | Dalebout |
| 9,254,416 | B2 | 2/2016 | Ashby |
| 9,278,248 | B2 | 3/2016 | Tyger |
| 9,278,249 | B2 | 3/2016 | Watterson |
| 9,278,250 | B2 | 3/2016 | Buchanan |
| 9,289,648 | B2 | 3/2016 | Watterson |
| 9,339,691 | B2 | 5/2016 | Brammer |
| 9,352,185 | B2 | 5/2016 | Hendrickson |
| 9,352,186 | B2 | 5/2016 | Watterson |
| 9,375,605 | B2 | 6/2016 | Tyger |
| 9,381,394 | B2 | 7/2016 | Mortensen |
| 9,387,387 | B2 | 7/2016 | Dalebout |
| 9,393,453 | B2 | 7/2016 | Watterson |
| 9,403,047 | B2 | 8/2016 | Olson |
| 9,403,051 | B2 | 8/2016 | Cutler |
| 9,421,416 | B2 | 8/2016 | Mortensen |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen |
| 9,498,668 | B2 | 11/2016 | Smith |
| 9,517,378 | B2 | 12/2016 | Ashby |
| 9,521,901 | B2 | 12/2016 | Dalebout |
| 9,533,187 | B2 | 1/2017 | Dalebout |
| 9,539,461 | B2 | 1/2017 | Ercanbrack |
| 9,579,544 | B2 | 2/2017 | Watterson |
| 9,586,086 | B2 | 3/2017 | Dalebout |
| 9,586,090 | B2 | 3/2017 | Watterson |
| 9,604,099 | B2 | 3/2017 | Taylor |
| 9,616,276 | B2 | 4/2017 | Dalebout |
| 9,616,278 | B2 | 4/2017 | Olson |
| 9,623,281 | B2 | 4/2017 | Hendrickson |
| 9,636,567 | B2 | 5/2017 | Brammer |
| 9,675,839 | B2 | 6/2017 | Dalebout |
| 9,682,307 | B2 | 6/2017 | Dalebout |
| 9,694,234 | B2 | 7/2017 | Dalebout |
| 9,694,242 | B2 | 7/2017 | Ashby |
| 9,737,755 | B2 | 8/2017 | Dalebout |
| 9,757,605 | B2 | 9/2017 | Olson |
| 9,764,186 | B2 | 9/2017 | Dalebout |
| 9,767,785 | B2 | 9/2017 | Ashby |
| 9,795,822 | B2 | 10/2017 | Smith |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby |
| 9,889,339 | B2 | 2/2018 | Douglass |
| 9,937,376 | B2 | 4/2018 | McInelly |
| 9,937,377 | B2 | 4/2018 | McInelly |
| 9,937,378 | B2 | 4/2018 | Dalebout |
| 9,937,379 | B2 | 4/2018 | Mortensen |
| 9,943,719 | B2 | 4/2018 | Smith |
| 9,943,722 | B2 | 4/2018 | Dalebout |
| 9,948,037 | B2 | 4/2018 | Ashby |
| 9,968,816 | B2 | 5/2018 | Olson |
| 9,968,821 | B2 | 5/2018 | Finlayson |
| 9,968,823 | B2 | 5/2018 | Cutler |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack |
| D827,733 | S | 9/2018 | Hochstrasser |
| 10,065,064 | B2 | 9/2018 | Smith |
| 10,071,285 | B2 | 9/2018 | Smith |
| 10,085,586 | B2 | 10/2018 | Smith |
| 10,086,254 | B2 | 10/2018 | Watterson |
| 10,136,842 | B2 | 11/2018 | Ashby |
| 10,186,161 | B2 | 1/2019 | Watterson |
| 10,188,890 | B2 | 1/2019 | Olson |
| 10,207,143 | B2 | 2/2019 | Dalebout |
| 10,207,145 | B2 | 2/2019 | Tyger |
| 10,207,147 | B2 | 2/2019 | Ercanbrack |
| 10,207,148 | B2 | 2/2019 | Powell |
| 10,212,994 | B2 | 2/2019 | Watterson |
| 10,220,259 | B2 | 3/2019 | Brammer |
| 10,226,396 | B2 | 3/2019 | Ashby |
| 10,226,664 | B2 | 3/2019 | Dalebout |
| 10,252,109 | B2 | 4/2019 | Watterson |
| 10,258,828 | B2 | 4/2019 | Dalebout |
| 10,272,317 | B2 | 4/2019 | Watterson |
| 10,279,212 | B2 | 5/2019 | Dalebout |
| 10,293,211 | B2 | 5/2019 | Watterson |
| D852,292 | S | 6/2019 | Cutler |
| 10,328,303 | B2 | 6/2019 | Frank |
| 10,343,017 | B2 | 7/2019 | Jackson |
| 10,376,736 | B2 | 8/2019 | Powell |
| 10,388,183 | B2 | 8/2019 | Watterson |
| 10,391,361 | B2 | 8/2019 | Watterson |
| D864,320 | S | 10/2019 | Weston |
| D864,321 | S | 10/2019 | Weston |
| 10,426,989 | B2 | 10/2019 | Dalebout |
| 10,433,612 | B2 | 10/2019 | Ashby |
| 10,441,840 | B2 | 10/2019 | Dalebout |
| 10,449,416 | B2 | 10/2019 | Dalebout |
| 10,471,299 | B2 | 11/2019 | Powell |
| D868,909 | S | 12/2019 | Cutler |
| 10,492,519 | B2 | 12/2019 | Capell |
| 10,493,349 | B2 | 12/2019 | Watterson |
| 10,500,473 | B2 | 12/2019 | Watterson |
| 10,543,395 | B2 | 1/2020 | Powell et al. |
| 10,561,877 | B2 | 2/2020 | Workman |
| 10,561,893 | B2 | 2/2020 | Chatterton |

(56) References Cited

U.S. PATENT DOCUMENTS

| | | | | |
|---|---|---|---|---|
| 10,561,894 | B2 | 2/2020 | Dalebout | |
| 10,569,121 | B2 | 2/2020 | Watterson | |
| 10,569,123 | B2 | 2/2020 | Hochstrasser | |
| 10,625,137 | B2 | 4/2020 | Dalebout | |
| 10,758,767 | B2 | 8/2020 | Olson | |
| 10,786,706 | B2 | 9/2020 | Smith | |
| 10,816,177 | B1 * | 10/2020 | Bayerlein | A63B 71/0622 |
| 10,864,407 | B2 | 12/2020 | Watterson | |
| 2002/0016235 | A1 | 2/2002 | Ashby | |
| 2002/0077221 | A1 | 6/2002 | Dalebout | |
| 2002/0159253 | A1 | 10/2002 | Dalebout | |
| 2003/0045406 | A1 | 3/2003 | Stone | |
| 2004/0091307 | A1 | 5/2004 | James | |
| 2004/0171464 | A1 | 9/2004 | Ashby | |
| 2004/0171465 | A1 | 9/2004 | Hald | |
| 2005/0049123 | A1 | 3/2005 | Dalebout | |
| 2005/0077805 | A1 | 4/2005 | Dalebout | |
| 2005/0107229 | A1 | 5/2005 | Wickens | |
| 2005/0164839 | A1 | 7/2005 | Watterson | |
| 2005/0227820 | A1 * | 10/2005 | Dyer | A63B 22/0242 482/8 |
| 2005/0272577 | A1 | 12/2005 | Olson | |
| 2007/0117683 | A1 | 5/2007 | Ercanbrack | |
| 2007/0254778 | A1 | 11/2007 | Ashby | |
| 2008/0051256 | A1 | 2/2008 | Ashby | |
| 2008/0242520 | A1 | 10/2008 | Hubbard | |
| 2008/0300110 | A1 | 12/2008 | Smith | |
| 2009/0105052 | A1 | 4/2009 | Dalebout | |
| 2010/0242246 | A1 | 9/2010 | Dalebout | |
| 2012/0237911 | A1 | 9/2012 | Watterson | |
| 2012/0295774 | A1 | 11/2012 | Dalebout | |
| 2013/0123083 | A1 | 5/2013 | Sip | |
| 2013/0165195 | A1 | 6/2013 | Watterson | |
| 2013/0172152 | A1 | 7/2013 | Watterson | |
| 2013/0172153 | A1 | 7/2013 | Watterson | |
| 2013/0178334 | A1 | 7/2013 | Brammer | |
| 2013/0178768 | A1 | 7/2013 | Dalebout | |
| 2013/0190136 | A1 | 7/2013 | Watterson | |
| 2013/0196298 | A1 | 8/2013 | Watterson | |
| 2013/0196821 | A1 | 8/2013 | Watterson | |
| 2013/0196822 | A1 | 8/2013 | Watterson | |
| 2013/0218585 | A1 | 8/2013 | Watterson | |
| 2013/0244836 | A1 | 9/2013 | Maughan | |
| 2013/0267383 | A1 | 10/2013 | Watterson | |
| 2013/0268101 | A1 | 10/2013 | Brammer | |
| 2013/0274067 | A1 | 10/2013 | Watterson | |
| 2013/0281241 | A1 | 10/2013 | Watterson | |
| 2014/0024499 | A1 | 1/2014 | Watterson | |
| 2014/0073970 | A1 | 3/2014 | Ashby | |
| 2014/0121071 | A1 | 5/2014 | Strom | |
| 2014/0135173 | A1 | 5/2014 | Watterson | |
| 2014/0274574 | A1 | 9/2014 | Shorten | |
| 2014/0274579 | A1 | 9/2014 | Olson | |
| 2014/0287884 | A1 | 9/2014 | Buchanan | |
| 2014/0309085 | A1 | 10/2014 | Watterson | |
| 2015/0182779 | A1 | 7/2015 | Dalebout | |
| 2015/0182781 | A1 | 7/2015 | Watterson | |
| 2015/0238817 | A1 | 8/2015 | Watterson | |
| 2015/0250418 | A1 | 9/2015 | Ashby | |
| 2015/0251055 | A1 | 9/2015 | Ashby | |
| 2015/0253735 | A1 | 9/2015 | Watterson | |
| 2015/0253736 | A1 | 9/2015 | Watterson | |
| 2015/0258560 | A1 | 9/2015 | Ashby | |
| 2016/0058335 | A1 | 3/2016 | Ashby | |
| 2016/0063615 | A1 | 3/2016 | Watterson | |
| 2016/0092909 | A1 | 3/2016 | Watterson | |
| 2016/0101311 | A1 | 4/2016 | Workman | |
| 2016/0107065 | A1 | 4/2016 | Brammer | |
| 2016/0121074 | A1 | 5/2016 | Ashby | |
| 2016/0148535 | A1 | 5/2016 | Ashby | |
| 2016/0148536 | A1 | 5/2016 | Ashby | |
| 2016/0158595 | A1 | 6/2016 | Dalebout | |
| 2016/0213976 | A1 | 7/2016 | So et al. | |
| 2016/0296800 | A1 * | 10/2016 | Devor | A63B 24/0087 |
| 2016/0346595 | A1 | 12/2016 | Dalebout | |
| 2017/0036053 | A1 | 2/2017 | Smith | |
| 2017/0056711 | A1 | 3/2017 | Dalebout | |
| 2017/0056715 | A1 | 3/2017 | Dalebout | |
| 2017/0124912 | A1 | 5/2017 | Ashby | |
| 2017/0193578 | A1 | 7/2017 | Watterson | |
| 2017/0266489 | A1 | 9/2017 | Douglass | |
| 2017/0270820 | A1 | 9/2017 | Ashby | |
| 2018/0036585 | A1 | 2/2018 | Powell | |
| 2018/0085630 | A1 | 3/2018 | Capell | |
| 2018/0089396 | A1 | 3/2018 | Capell | |
| 2018/0099116 | A1 | 4/2018 | Ashby | |
| 2018/0099180 | A1 | 4/2018 | Wilkinson | |
| 2018/0111034 | A1 | 4/2018 | Watterson | |
| 2018/0117385 | A1 | 5/2018 | Watterson | |
| 2018/0117393 | A1 | 5/2018 | Ercanbrack | |
| 2018/0154209 | A1 | 6/2018 | Watterson | |
| 2018/0200566 | A1 | 7/2018 | Weston | |
| 2018/0235518 | A1 * | 8/2018 | Barton | A61B 5/0024 |
| 2019/0058370 | A1 | 2/2019 | Tinney | |
| 2019/0080624 | A1 | 3/2019 | Watterson | |
| 2019/0111318 | A1 * | 4/2019 | Evancha | A63B 24/0087 |
| 2019/0168072 | A1 | 6/2019 | Brammer | |
| 2019/0178313 | A1 | 6/2019 | Wrobel | |
| 2019/0192898 | A1 | 6/2019 | Dalebout | |
| 2019/0192952 | A1 | 6/2019 | Powell | |
| 2019/0223612 | A1 | 7/2019 | Watterson | |
| 2019/0232112 | A1 | 8/2019 | Dalebout | |
| 2019/0240535 | A1 | 8/2019 | Santra et al. | |
| 2019/0240540 | A1 * | 8/2019 | Wei | A63B 22/0235 |
| 2019/0269958 | A1 | 9/2019 | Dalebout | |
| 2019/0269971 | A1 | 9/2019 | Capell | |
| 2019/0275366 | A1 | 9/2019 | Powell | |
| 2019/0282852 | A1 | 9/2019 | Dalebout | |
| 2019/0328079 | A1 | 10/2019 | Ashby | |
| 2019/0329091 | A1 | 10/2019 | Powell | |
| 2019/0376585 | A1 | 12/2019 | Buchanan | |
| 2020/0009417 | A1 | 1/2020 | Dalebout | |
| 2020/0016459 | A1 | 1/2020 | Smith | |
| 2020/0222751 | A1 | 7/2020 | Dalebout | |
| 2020/0238130 | A1 | 7/2020 | Silcock | |
| 2020/0338389 | A1 | 7/2020 | Dalebout | |
| 2020/0254295 | A1 | 8/2020 | Watterson | |
| 2020/0254309 | A1 | 8/2020 | Watterson | |
| 2020/0254311 | A1 | 8/2020 | Watterson | |
| 2020/0391069 | A1 | 8/2020 | Olson | |
| 2020/0368575 | A1 | 11/2020 | Hays | |
| 2021/0046351 | A1 | 2/2021 | Ercanbrack | |
| 2021/0046353 | A1 | 2/2021 | Dalebout | |
| 2021/0086013 | A1 | 3/2021 | Olson | |
| 2021/0086018 | A1 | 3/2021 | Dalebout | |
| 2021/0086032 | A1 | 3/2021 | Watterson | |

FOREIGN PATENT DOCUMENTS

| | | | |
|---|---|---|---|
| WO | WO2014/153201 | 9/2014 | |
| WO | WO2016/065077 | 4/2016 | |
| WO | WO-2019143488 A1 * | 7/2019 | A63B 22/0023 |

OTHER PUBLICATIONS

AnonymousYT's YouTube video screenshot ("Call of Duty: Mobile—First Look! Alpha Version (2018) HD" https://www.youtube.com/watch?v=vZtbV71NHTU Dec. 13, 2018) (Year: 2018).*

Shirrako's YouTube video screenshot ("Call of Duty Modern Warfare—Team Deathmatch Gameplay Multiplayer (Ray Tracing)" https://www.youtube.com/watch?v=9NtdvZSNz1U Oct. 27, 2019) (Year: 2019).*

International Search Report and Written Opinion for PCT/US2021/022749, dated Jun. 30, 2021, 9 pages.

U.S. Appl. No. 13/088,007, filed Apr. 15, 2011, Scott R. Watterson.

U.S. Appl. No. 15/973,176, filed May 7, 2018, Melanie Douglass.

U.S. Appl. No. 17/014,935, filed Sep. 8, 2020, Megan Jane Ostler.

U.S. Appl. No. 17/066,485, filed Oct. 9, 2020, Jared Weston.

U.S. Appl. No. 17/067,310, filed Oct. 9, 2020, Jared Willardson.

U.S. Appl. No. 17/096,350, filed Nov. 12, 2020, William T. Dalebout.

U.S. Appl. No. 17/141,880, filed Jan. 5, 2021, Wade A. Powell.

(56) References Cited

OTHER PUBLICATIONS

U.S. Appl. No. 17/149,299, filed Jan. 14, 2021, William T. Dalebout.
U.S. Appl. No. 17/159,814, filed Jan. 27, 2021, William T. Dalebout.
U.S. Appl. No. 17/172,880, filed Feb. 10, 2021, Darren C. Ashby.
U.S. Appl. No. 17/178,173, filed Feb. 17, 2021, Evan Charles Tinney.
U.S. Appl. No. 17/209,714, filed Mar. 23, 2021, Chase Brammer.
U.S. Appl. No. 29/702,127, filed Sep. 16, 2019, Gordon Cutler.
U.S. Appl. No. 62/897,113, filed Sep. 9, 2019, Megan Jane Ostler.
U.S. Appl. No. 63/073,081, filed Sep. 1, 2020, Darren C. Ashby.
U.S. Appl. No. 63/079,697, filed Sep. 17, 2020, Jared Willardson.
U.S. Appl. No. 63/086,793, filed Oct. 2, 2020, Darren C. Ashby.
U.S. Appl. No. 63/134,036, filed Jan. 5, 2021, Gaylen Ercanbrack.
U.S. Appl. No. 63/150,066, filed Feb. 16, 2021, Kent M. Smith.
U.S. Appl. No. 63/156,801, filed Mar. 4, 2021, Eric S. Watterson.

* cited by examiner

SYSTEMS AND METHODS FOR TREADMILL DRIFT AVOIDANCE

CROSS-REFERENCE TO RELATED APPLICATIONS

This application claims priority to provisional patent application No. 62/991,378 entitled "SYSTEMS AND METHODS FOR TREADMILL DRIFT AVOIDANCE" filed Mar. 18, 2020, which application is herein incorporated by reference for all that it discloses.

BACKGROUND

Background and Relevant Art

When operating a treadmill, a user may walk, run, or otherwise move on a rotating belt. In this manner, the user may exercise by walking or running a distance (from several feet to several miles) from a single, often indoors, location. While operating the treadmill, the user may drift, or move laterally to the left or to the right. If the user moves off the treadmill, he or she may fall off the treadmill and be injured or have their workout interrupted.

BRIEF SUMMARY

In some embodiments, a treadmill includes a front end, a back end, and a tread belt that extends between the front end and the back end. A console located at the front of the treadmill includes one or more sensors. The sensors sense the lateral position of the user. An alert is provided if the user is close to the lateral edge of the tread belt and/or the exercise deck.

In other embodiments, a method for operating a treadmill includes rotating a tread belt from a front end of a deck to a rear end of the deck. A lateral position of a user is sensed. An alert is provided on a console located at the front end of the deck when the lateral position of the user is close to the lateral edge of the tread belt. In some embodiments, the alert may be provided if the user is within an alert percentage of the width of the tread belt, or within an alert zone on the tread belt.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 2-1 through FIG. 2-6 are representations of a display of a console, according to at least one embodiment of the present disclosure;

FIG. 3-1 and FIG. 3-2 are representations of a tread belt, according to at least one embodiment of the present disclosure;

FIG. 4 is a representation of a cross-sectional view of an exercise deck, according to at least one embodiment of the present disclosure;

FIG. 5 is a representation of a flow chart for a treadmill, according to at least one embodiment of the present disclosure;

FIG. 6 is a representation of another flow chart for a treadmill, according to at least one embodiment of the present disclosure;

DETAILED DESCRIPTION

This disclosure relates to devices, systems, and methods for a drift avoidance system on a treadmill. As a user walks, runs, or otherwise operates a treadmill, the user may tend to "drift," or to move laterally (e.g., to the left or to the right) on the tread belt. A sensor, such as a motion sensor, may sense the lateral position of the user. If the user drifts too far to the right or to the left, an alert (such as a light) may be displayed in a location visible to the user, such as on the console, and/or on a display of the console. This may help remind the user to stay on the tread belt. Furthermore, this may alert the user that he or she is not in the optimal safe operating position (e.g., not in the center of the tread belt).

The present disclosure includes practical applications that provide benefits and/or solve problems associated with conventional treadmill exercise machines. In particular, the systems and methods described herein provide specific features and functionalities that identify the lateral position of a user on a tread belt and alert the user if she has drifted too close to the edge of the tread belt.

For example, in one or more embodiments described herein, sensing the lateral position of the user with a motion sensor may prevent the user from tripping or falling as a result of stepping on the unmoving side of the treadmill. Furthermore, an alert located on the console may be readily visible for the user during an exercise session. The user may direct his attention to the console for a variety of reasons, including exercise session information, trainer videos, scenery videos, biometric information, and combinations thereof. Furthermore, the console is located at the front end of the exercise deck, which is the direction that the user typically faces. By including the alert on the console, the user may be more likely to view it. This may help to alert the user that he is drifting off the tread belt, so he may correct his position before falling off the treadmill. This may increase the safety of the treadmill by reducing tripping and falling related injuries.

In some examples, in one or more embodiments described herein, a sensor located on a console may determine a lateral position of the user. A sensor on the console may reduce the total number of sensors needed to sense the lateral position of the user. Because the console is located above the tread belt, the sensor may have a long field of view. Indeed, this may allow a single sensor to sense lateral position along the length of the deck.

Figure 1:
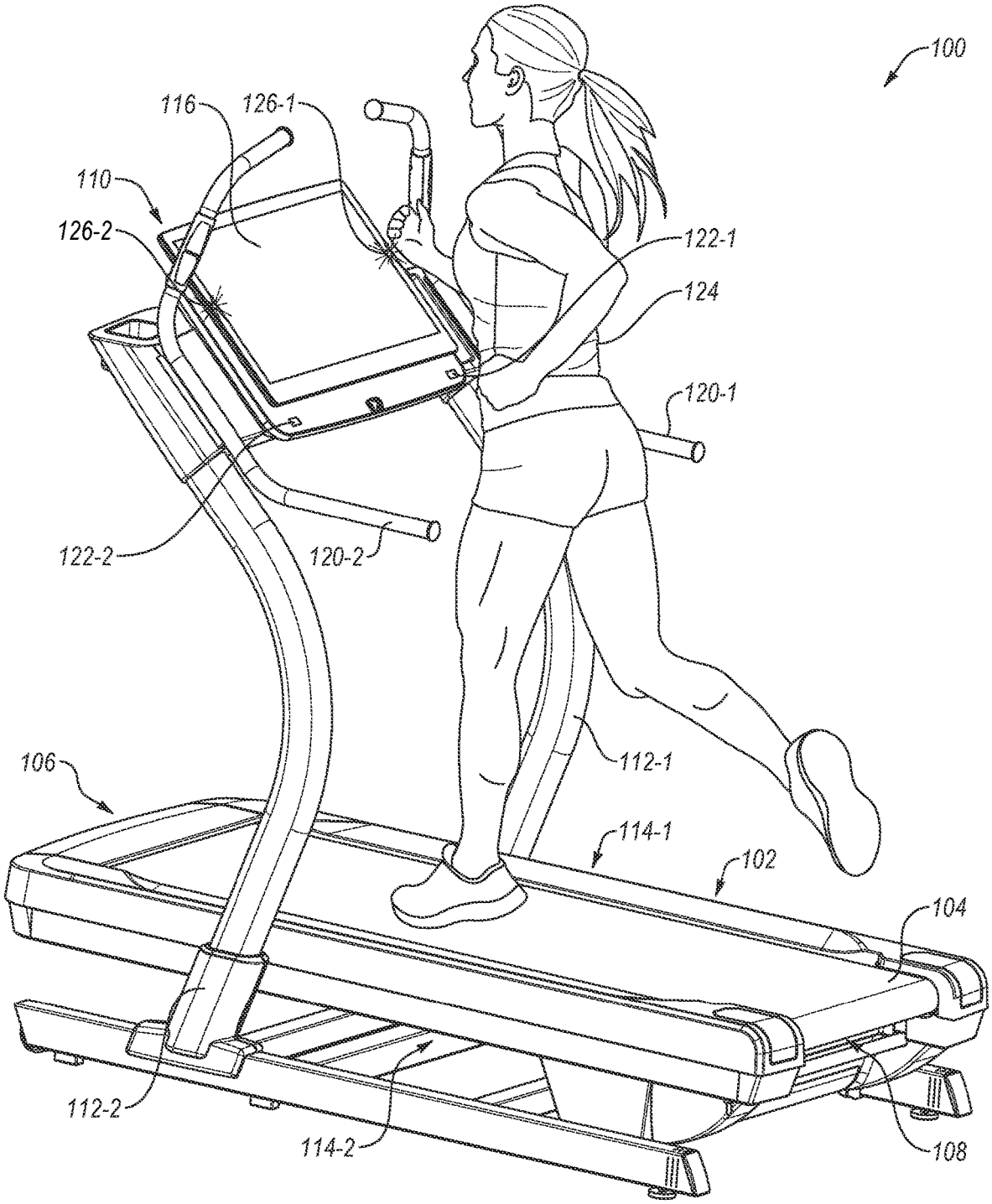
FIG. 1 is a representation of a perspective view of a treadmill, according to at least one embodiment of the present disclosure.

Referring now to the figures, FIG. 1 is a representation of a treadmill 100, according to at least one embodiment of the present disclosure. The treadmill 100 includes an exercise deck 102. A tread belt 104 extends around a portion of the exercise deck 102. The treadmill 100 includes a first pulley at a front end 106 (e.g., a first end) of the exercise deck 102 and a second pulley at a rear end 108 (e.g., a second end) of the exercise deck 102. The tread belt 104 may extend around the first pulley and the second pulley. The tread belt 104 may rotate around the exercise deck 102, supported at the front end 106 by the first pulley and at the rear end 108 by the second pulley. In some embodiments, one or both of the first pulley and the second pulley may be driven with a motor, which may cause the tread belt 104 to rotate. In some embodiments, force applied by a user 124 walking or running on the tread belt 104 may cause the tread belt 104 to rotate.

The treadmill 100 includes a console 110. In the embodiment shown, the console 110 is located above the exercise deck 102 at or near the front end 106. The tread belt 104 may rotate such that the top portion of the tread belt 104 (e.g., the portion seen in FIG. 1) may travel from the front end 106 to the rear end 108. In this manner, the user 124 may face the console 110 while walking or running on the treadmill.

In the embodiment shown, the console 110 is supported by a first post 112-1 and a second post 112-2. The first post 112-1 is located on a first lateral side 114-1 (e.g., the right side) of the exercise deck 102 and the second post 112-2 is located on a second lateral side 114-2 (e.g., the left side) of the exercise deck 102. The console 110 includes a display 116 (such as a video screen, a touch screen display, or other screen). Exercise parameters, such as tread belt speed, exercise deck incline angle, biometric parameters (e.g., heartrate), may be displayed on the display 116. A first handle 120-1 and a second handle 120-2 may be connected to the console 110 and/or the first post 112-1 and the second post 112-2. While the console 110 has been described as being supported by the first post 112-1 and the second post 112-2 and connected to the first handle 120-1 and the second handle 120-2, it should be understood that one or more of the first post 112-1, the second post 112-2, the first handle 120-1, and the second handle 120-2 may be a part of (e.g., integrated with, formed with, part of the same structure) the console 110.

A sensor (collectively 122) may be located on the console 110. The sensor 122 may sense the lateral position of the user 124. For example, the sensor 122 may sense how close the user 124 is to the first lateral side 114-1 or to the second lateral side 114-2 of the exercise deck 102. The sensor 122 may be any type of sensor 122. For example, the sensor 122 may be a motion detection sensor, a time-of-flight sensor, an optical sensor, a camera sensor, an infrared sensor, any other type of sensor, and combinations thereof.

In some embodiments, the console 110 may include a plurality of sensors 122. For example, the console 110 shown includes a first sensor 122-1 on the first lateral side 114-1 and a second sensor 122-2 on the second lateral side. However, it should be understood that the plurality of sensors 122 may be located at any location of the console 110, including in the center of the console 110 or otherwise located on the console 110. In some embodiments, each sensor 122 of the plurality of sensors 122 may be the same type of sensor. In some embodiments, the plurality of sensors 122 may include different types of sensors. For example, the first sensor 122-1 may be a motion sensor and the second sensor 122-2 may be a camera sensor.

In some embodiments, a first sensor 122-1 located on the first lateral side 114-1 may sense if the user 124 is getting close to the first lateral side 114-1. The second sensor 122-2 located on the second lateral side 114-2 may sense if the user is getting close to the second lateral side 114-2. Thus, each sensor 122 may independently sense if the user 124 is getting close to the lateral side of the exercise deck 102. In some embodiments, the first sensor 122-1 may sense if the user 124 is getting close to both the first lateral side 114-1 and the second lateral side 114-2. In some embodiments, the second sensor 122-2 may sense if the user 124 is getting close to both the first lateral side 114-1 and the second lateral side 114-2.

If the sensor 122 senses that the user 124 is close to the first lateral side 114-1 or the second lateral side 114-2, then an alert may be presented. For example, an indicator (collectively 126) may indicate that the user 124 is close to the first lateral side 114-1 or the second lateral side 114-2. In some embodiments, the indicator 126 may be a light. For example, if the sensor 122 senses that the user 124 is close to the first lateral side 114-1 or the second lateral side 114-2, then the indicator 126 light may flash to grab the attention of the user 124. In some embodiments, the indicator 126 may be a sound. For example, if the sensor 122 senses that the user 124 is close to the first lateral side 114-1 or the second lateral side 114-2, then the indicator 126 may make a sound. In some embodiments, the indicator 126 may include haptic feedback. For example, if the sensor 122 senses that the user 124 is close to the first lateral side 114-1 or the second lateral side 114-2, then the indicator 126 may vibrate, buzz, shake, or otherwise provide a physical indication to the user 124. In some embodiments, the indicator 126 may include a combination of one or more of a light, a sound, and haptic feedback.

In some embodiments, the indicator 126 may be located at the front end 106 of the treadmill 100 and/or exercise deck 102. For example, the indicator 126 may be located on the console 110. In some embodiments, the indicator 126 may not be located on the exercise deck. In some embodiments, the indicator 126 may not be located on a siderail or other feature on the lateral side of the exercise deck. In some examples, the indicator 126 may be incorporated into the display 116. In some embodiments, the console 110 may include a separate light (e.g., a light bulb, LED light).

In some embodiments, an exercise video may play on the display 116. When the sensor 122 senses that the user 124 is close to the lateral edge of the exercise deck 102, then a portion of the display may change color. For example, the portion of the display may change to red, yellow, green, blue, purple, or any other color. In some embodiments, the indicator 126 may be overlaid over the exercise video playing on the display 116. For example, the indicator 126 may interrupt the exercise video. In some examples, the exercise program may stop (e.g., the timer and distance measurements may pause in their recordings) when the indicator 126 is activated. In some examples, the exercise video may be visible through the indicator 126, and the exercise video may continue while the indicator 126 is activated.

In some embodiments, an indicator 126 may change based on the location of the user 124. For example, as the user 124 moves closer to the lateral edge of the exercise deck 102, the indicator may increase in intensity (e.g., brightness, sound). In some embodiments, as the user 124 moves closer to the lateral edge, the indicator 126 may change in color. For example, at a first distance from the lateral edge, the indicator 126 may show a first color (such as yellow). At a second distance from the lateral edge, the indicator 126 may show a second color (such as red). The colors may be indications of the proximity to the lateral edge. For example, red may indicate a position that is closer to the lateral edge than yellow.

In some embodiments, the indicator 126 may always provide an indication of the distance of the user 124 to the lateral edge (e.g., the indicator 126 may always be on). If the user is "safe," or located far away from the lateral edge, the indicator 126 may be green, as the user moves toward the lateral edge, the indicator 126 may change color from green to yellow to red (including any number of color gradations therebetween, and/or any number of additional colors).

In some embodiments, the indicator 126 may be always on. For example, if the user 124 is in the center of the tread belt 104, then the indicator 126 may provide a positive indication, such as a green light or a low intensity light. As the user moves closer to the lateral edge of the tread belt 104, the indicator 126 may change the urgency of the indication, such as by changing colors or increasing in intensity. In this manner, the user 124 may glance at the indicator 126 to receive an indication of her lateral location on the tread belt 104, without having to look down at the tread belt 104. This may reduce the chance that the user 124 may fall and/or injure herself.

In some embodiments, the indicator 126 may include a first indicator 126-1 and a second indicator 126-2. The first indicator 126-1 may be located on the first lateral side 114-1 of the display 116 and the second indicator 126-2 may be located on the second lateral side 114-2 of the display 116. When the sensor 122 detects or determines that the user 124 is close to the first lateral side 114-1, the first indicator 126-1 may provide an indication (e.g., light up). Similarly, when the sensor 122 detects or determines that the user 124 is close to the second lateral side 114-2, the second indicator 126-2 may provide an indication (e.g., light up).

FIG. 2-1 through FIG. 2-6 are representations of a display 216 with various positions and/or embodiments of indicators (collectively 226). The display 216 may play a video, such as an exercise video, a video of real scenery, a video of animated scenery, or other exercise video. In FIG. 2-1 through FIG. 2-4, a right indicator 226-1 is located on a right side 214-1 of the display 216 and a left indicator 226-2 is located on a left side 214-2 of the display 216. When the user (e.g., user 124 of FIG. 1) moves close to the lateral edge of the tread belt (e.g., tread belt 104 of FIG. 1), one or both of the indicators 226 may light up. In some embodiments, when the user moves close to either the first lateral edge or the second lateral edge, both of the indicators 226 may light up (e.g., independent of to which lateral edge the user is close). In some embodiments, when the user moves close to the right edge of the tread belt, the right indicator 226-1 may light up. In some embodiments, when the user moves close to the left edge of the tread belt, the left indicator 226-2 may light up.

In some embodiments, the indicators 226 may light up with a constant brightness. In some embodiments, an intensity of the brightness of the indicator 226 may be dependent on how close to the edge of the tread belt the user is. For example, as the user moves closer to the edge of the tread belt, the brightness of the indicator 226 may increase.

Figures 1, 2:
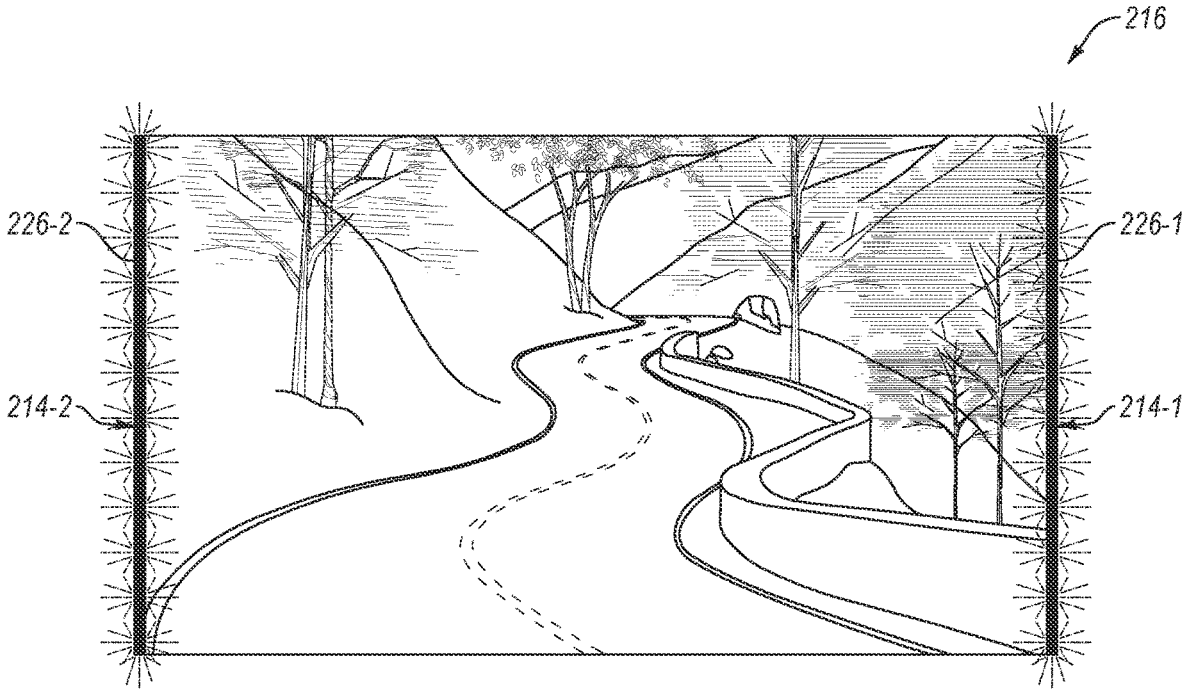
Figure 2:
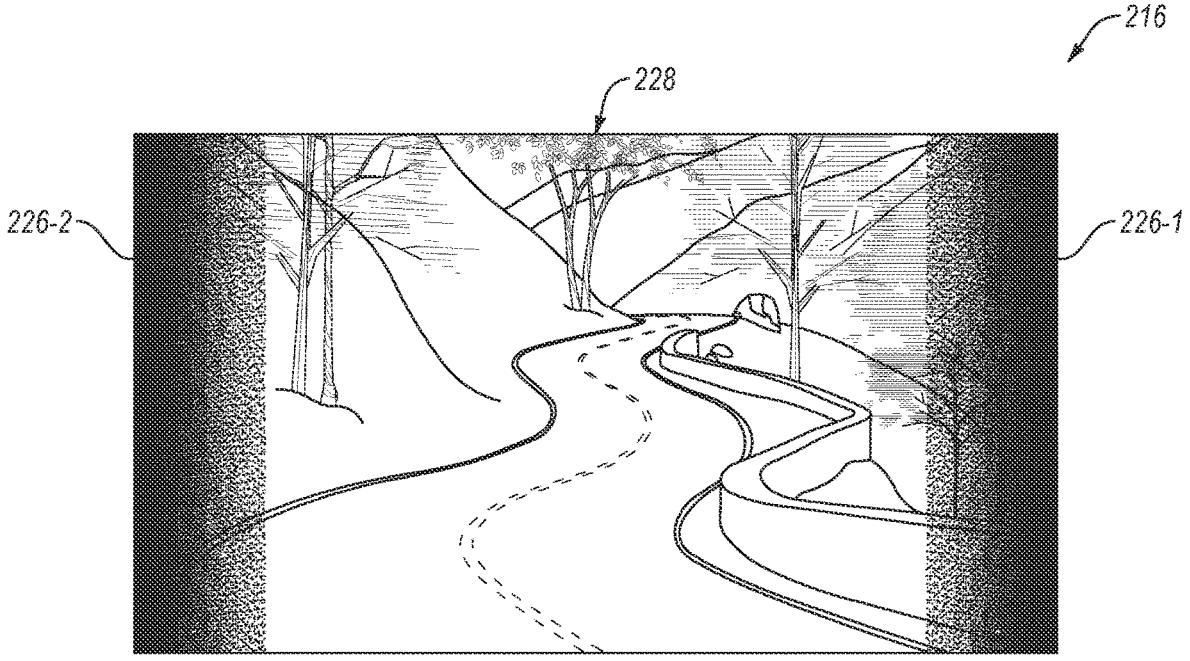

In the embodiment shown in FIG. 2-1, the indicators 226 may pulse (e.g., blink, flash) on and off when the user moves close to the edge of the tread belt. In some embodiments, as the user moves closer to the edge of the tread belt, the speed of the pulsing may increase. In some embodiments, the color of the indicator 226 may change based on the proximity of the user to the edge of the tread belt (e.g., green for safe, yellow for caution, and red for danger). In some embodiments, the indicators 226 may change color and pulse as the user moves closer to the edge of the tread belt. In some embodiments, the indicators 226 may only change color or pulse with the same color as the user moves closer to the edge of the tread belt.

In the embodiment shown in FIG. 2-2, the indicators 226 may overlay a portion of the display 216. In some embodiments, as the user moves closer to the lateral edge of the exercise deck, the overlay may change. For example, the opacity (or translucence) of the indicator 226 may change based on the position of the user 224. If the user is closer to the lateral edge, the indicator 226 may become more opaque, thereby increasing the urgency of the alert to the user. In some embodiments, the indicator may increase the extent of the overlay (e.g., from the right edge 214-1 or the left edge 214-2) based on the distance the user 224 is located form the lateral edge. As the user moves closer to the lateral edge, the indicator 226 may extend further toward the center 228 of the display 210, thereby making it more visible (e.g., increasing the urgency) to the user 224. In some embodiments, the color of the overlay may change as the user moves close to the edge of the tread belt. In some embodiments, the color and the opacity may change as the user moves close to the edge of the tread belt.

Figures 2, 3:
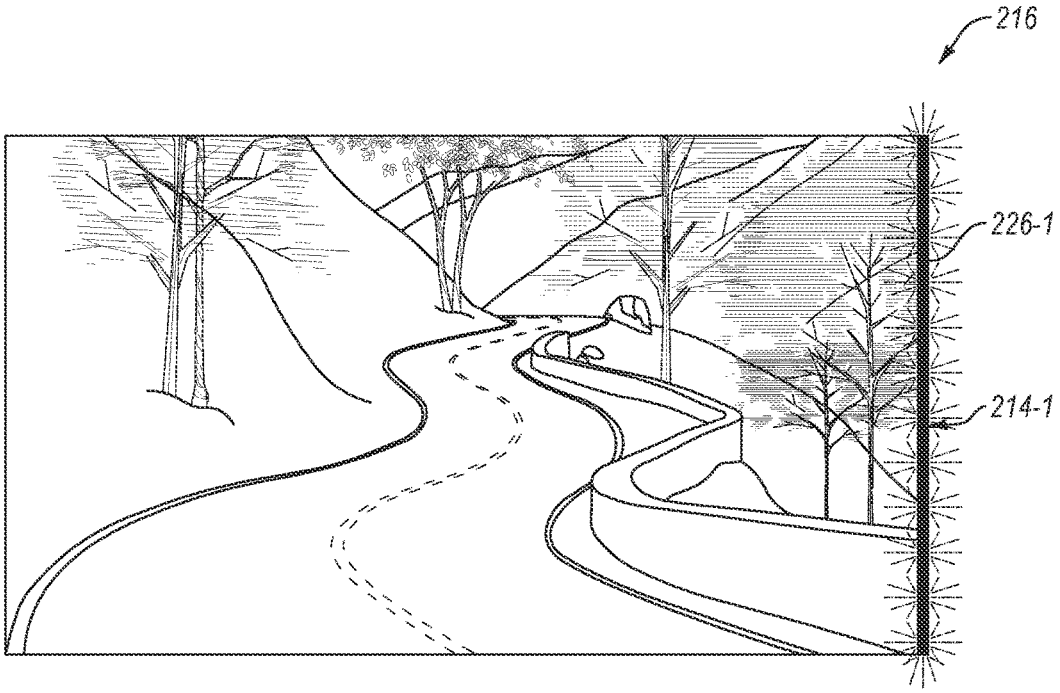
Figures 2, 3, 4:
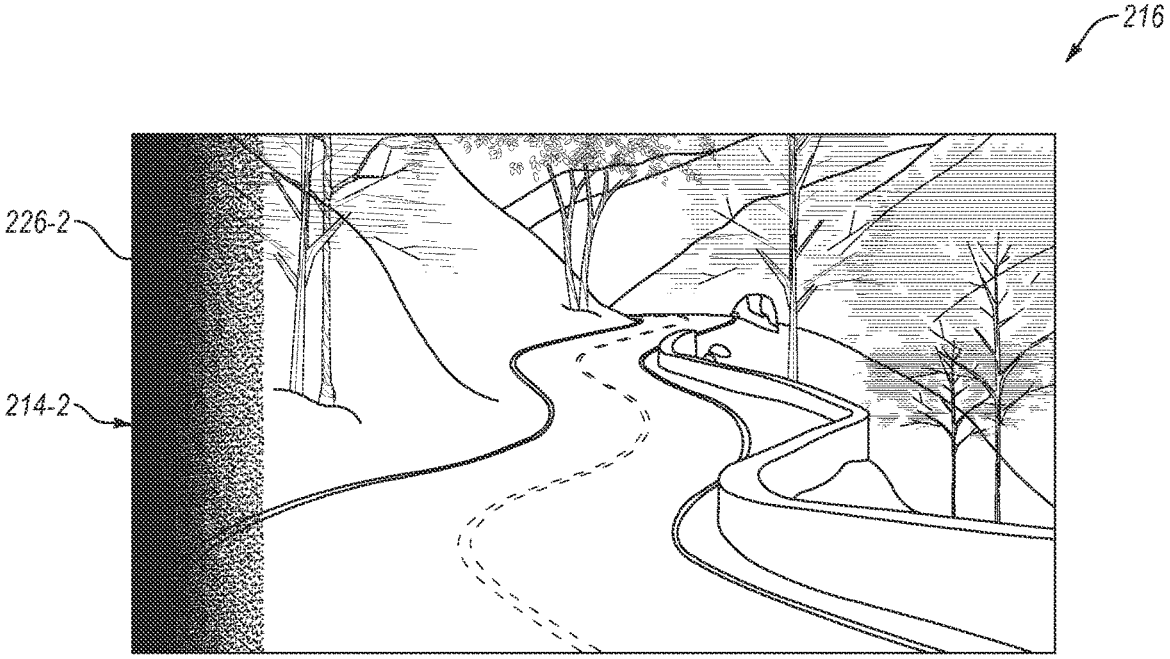

In the embodiment shown in FIG. 2-3, the first indicator 226-1 is lit on the right side 214-1 of the display 216. This may happen, for example, if the user has moved too close to the right side of the tread belt. In the embodiment shown in FIG. 2-4, the second indicator 226-2 is lit on the left side 214-2 of the display 216. This may happen, for example, if the user has moved too close to the left side of the treadmill. Thus, as may be seen, the indicator 226 may only be lit on a single side (e.g., the right side 214-1, the left side 214-2) of the display 216. While the embodiment of FIG. 2-3 is shown with the indicator shown in FIG. 2-1 and the embodiment of FIG. 2-4 is shown with the indicator shown in FIG. 2-2, it should be understood that either indicator, or any other indicator, may be used solely on both the right side 214-1 or the left side 214-2.

In the embodiment shown in FIG. 2-5, the indicator 226 may be located at a bottom edge 230 of the display 216. While the embodiments discussed in reference to FIG. 2-3 and FIG. 2-4 describe the indicator 226 as being located on the bottom edge 230 of the display 216, it should be understood that the indicator 226 may be located anywhere on the display 216, including the top edge 232, the right side 214-1, the left side 214-2, and combinations thereof.

The indicator 226 may include a light that lights up based on a relative position of the user. For example, if the user is operating in the center of the tread belt, then the indicator 226 may be lit up at the center 228 of the bottom edge 230. As the user moves toward the right side or the left side of the tread belt, the indicator 226 may light up closer toward the right side 214-1 or the left side 214-2 of the display 216. In some embodiments, the indicator 226 may move closer to the right side 214-1 or the left side 214-2 based on the relative proximity of the user to the right side or the left side of the tread belt. In some embodiments, the display 216 may include an indicator for each foot. In this manner, the user may track the position of each foot relative to the edge of the tread belt. This may help increase the safety of the user and improve the user's sense of position on the tread belt.

In the embodiment shown in FIG. 2-6, the indicator 226 may include an symbol representative of the relative location of the user on the tread belt. The symbol may be any symbol, including an arrow, a circle, a foot print, a shoe, a person, or any other symbol. Similar to the indicator 226 discussed above with respect to FIG. 2-3, the indicator 226 may move relative to the center 228 of the bottom edge 230 based on the relative position of the user. In some embodiments, the indicator 226 may include a virtual representation of the treadmill on the display 216, and a cartoon or other symbol representing the user may be superimposed over the treadmill to indicate the user's lateral position.

FIG. 3-1 is a front view of a treadmill 300, according to at least one embodiment of the present disclosure. The treadmill 300 shown includes a console 310 located at a front end 306 of the exercise deck 302. One or more sensors (collectively 322) may be located on the console 310. The sensors 322 may be configured to sense the lateral position of the user. In some embodiments, the sensors 322 may be able to sense the lateral position of the user on the tread belt 304. For example, the sensors 322 may have a line-of-sight of a portion or an entirety of the tread belt 304.

The sensors 322 may be located at any location on the treadmill 300. For example, as shown, the sensors 322 may be located on the console 310. In some embodiments, the sensors 322 may be located on the handles 320, on the posts 312, on the tread deck 302, or in any other location. In some embodiments, the treadmill 300 may include a plurality of sensors 322, such as a first sensor 322-1 on a first lateral side 314-1 of the treadmill 300 and a second sensor 322-2 on a second lateral side 314-2 of the treadmill 300.

In some embodiments, to sense or detect the lateral position of the user, the sensors 322 may detect the lateral location of a user's feet (collectively 334). For example, the sensors 322 may detect the lateral position of a right foot 334-1 and the lateral position of a left foot 334-1. In some embodiments, the lateral position may be measured relative to the outer edge 336 of the exercise deck 302. In some embodiments, the lateral position may be measured relative to the lateral edge 338 of the tread belt 304. In some embodiments, the lateral position may be measured relative to the center of the foot 334. In some embodiments, the lateral position may be measured relative to the outer edge of the foot 334. In some embodiments, the lateral position may be measured relative to the inner edge of the foot.

If the lateral position is close to the edge of the exercise deck 302 or the tread belt, an indicator 326 may alert the user. For the purposes of this disclosure, close may be any distance that provides a risk of tripping and/or falling for the user. For example, close may be measured in terms of an alert percentage of the tread belt width 340. For example, close may be 20%, 15%, 10%, 5%, 4%, 3%, 2%, 1%, 0.5%, 0.1%, of a width of the treadmill. When the user's foot 334 comes within the alert percentage to the lateral edge 338 of the tread belt 304 and/or the exercise deck 302, the indicator 326 may alert the user.

In some embodiments, the alert percentage may be set by the manufacturer, and may not be changed by the user. In some embodiments, the user may set the alert percentage, based on her use preferences. In some embodiments, the alert percentage may change based on the rotational speed of the tread belt. For example, the alert percentage may be decreased (e.g., the user may move closer to the edge of the tread belt 304 and/or the exercise deck 302 before receiving an alert) at slower speeds, and increased (e.g., the user may not move as close to the edge of the tread belt 304 and/or the exercise deck 302 before receiving an alert) at higher speeds.

In some embodiments the tread belt 304 may move laterally (e.g., track) along the exercise deck. The sensors 322 may sense the position of the lateral edge 338 of the tread belt 304 and the lateral position of the user's foot 334 to determine the distance (e.g., the alert percentage) of the user's foot 334 from the lateral edge 338 of the tread belt 304.

FIG. 3-2 is a representation of a treadmill 300 including one or more alert zones 342, according to at least one embodiment of the present disclosure. The sensors 322 may detect for the presence of the user (e.g., the user's foot) in an alert zone (collectively 342). If the user's foot (or other body part) crosses the alert zone 342, then the indicator 326 may alert the user. In this manner, the sensor does not need to determine or calculate distances between the user's foot and the edge of the tread belt 304. The sensor 322 can simply sense if the user enters the alert zone 342. For example, the sensor 322 may be a motion sensor, and any motion within the alert zone 342 may cause the indicator 326 to alert the user.

In some embodiments, the treadmill 300 may include multiple alert zones 342. For example, a first alert zone 342-1 may be located closer to the center 328 of the tread belt 304 than a second alert zone 342-2. If the user enters the first alert zone 342-1, then the indicator 326 may provide a "mild" alert (e.g., a yellow light) to the user. If the user enters the second alert zone 342-2, and is therefore closer to the lateral edge 338 of the tread belt 304, then the indicator 326 may provide an "urgent" alert (e.g., a red light) to the user. In some embodiments, the treadmill 300 may include any number of alert zones 342, including 1, 2, 3, 4, 5, 6, 7, 8, 9, 10, or more alert zones 342.

FIG. 4 is a representation of a cross-sectional view of a treadmill 400, according to at least one embodiment of the present disclosure. An upper surface 444 of an exercise deck 402 includes a plurality of sensors 426. Thus, the sensors 426 may be located between the exercise deck 402 and a tread belt 404. In some embodiments, the sensors 426 may be embedded in the exercise deck 402. The sensors 426 may be located in a pattern across the exercise deck. In some embodiments, the sensors 426 may be weight or pressure sensors. As the user walks or runs on the treadmill 400, the sensors 426 may detect the weight of the user. The lateral location of the user may be determined or inferred by identifying which of the sensors 426 has been triggered. Thus, if a sensor 426 on the left lateral side 414-2 is triggered, then the treadmill 400 may know that the user is near the left lateral edge of the tread belt 404. An indicator (e.g., indicator 126 of FIG. 1) may alert the user that she is close to the left lateral edge of the tread belt 404. Similarly, if a sensor 426 on the right lateral side 414-1 is triggered, then the treadmill 400 may know that the user is near the right lateral edge of the tread belt 404. An indicator may then alert the user that she is close to the right lateral edge of the tread belt 404.

Figures 2, 3, 4, 5:
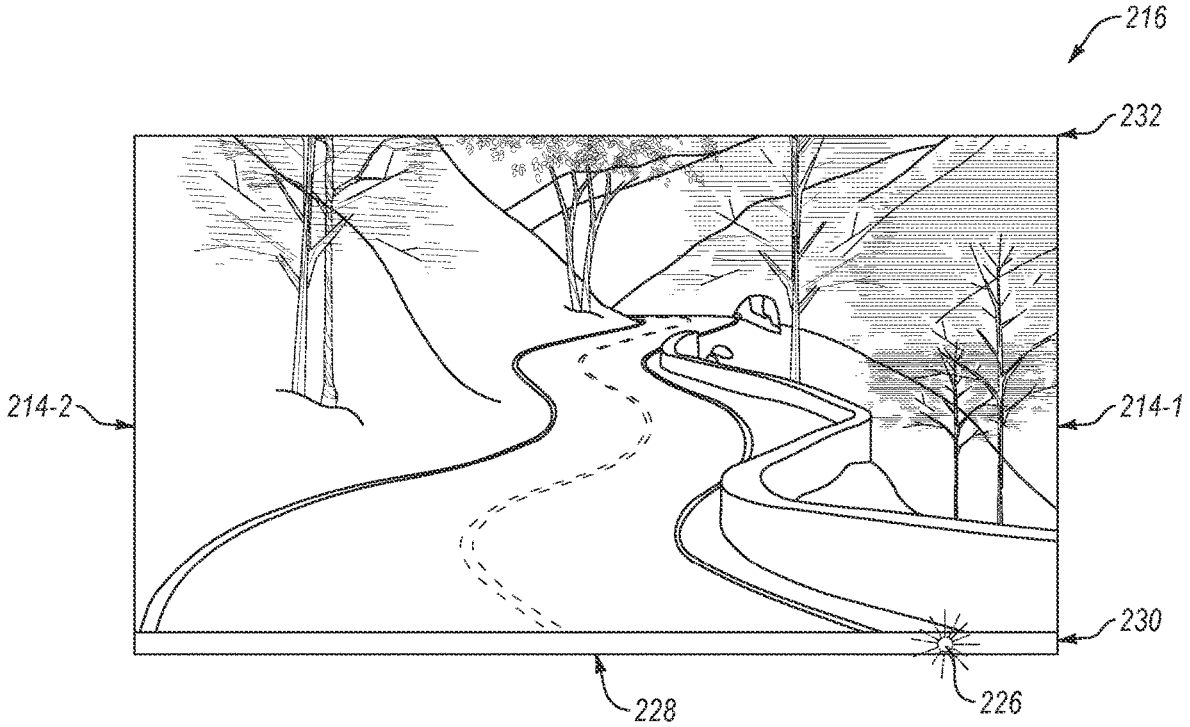

FIG. 5 is a flowchart 546 used to determine when to alert a user, according to at least one embodiment of the present disclosure. After starting the treadmill at 548, the lateral position of a user may be sensed at 550. The treadmill then determines if the user is close to the lateral edge of the tread belt at 552. If the user is not close (e.g., outside of an alert percentage, outside an alert zone) to the lateral edge of the tread belt, then the treadmill will sense the position of the user again. If the user is close (e.g., within an alert percentage, inside an alert zone) to the lateral edge of the tread belt, then an alert is supplied to the user at 554. After the user is alerted, the position of the user is sensed again. This process may loop indefinitely.

In some embodiments, the position of the user may be sensed regularly, such as on a sensing interval. In some embodiments, the sensing interval may be less than 1 s, 0.9 s, 0.8 s, 0.7 s, 0.6 s, 0.5 s, 0.4 s, 0.3 s, 0.2 s, 0.1 s, 0.05 s, 0.01 s, or any value therebetween. In some embodiments, the lateral position of the user may be sensed with every footfall. It may be critical that the position of the user is sensed every footfall because the position of the user may change with every step.

Figures 2, 3, 4, 5, 6:
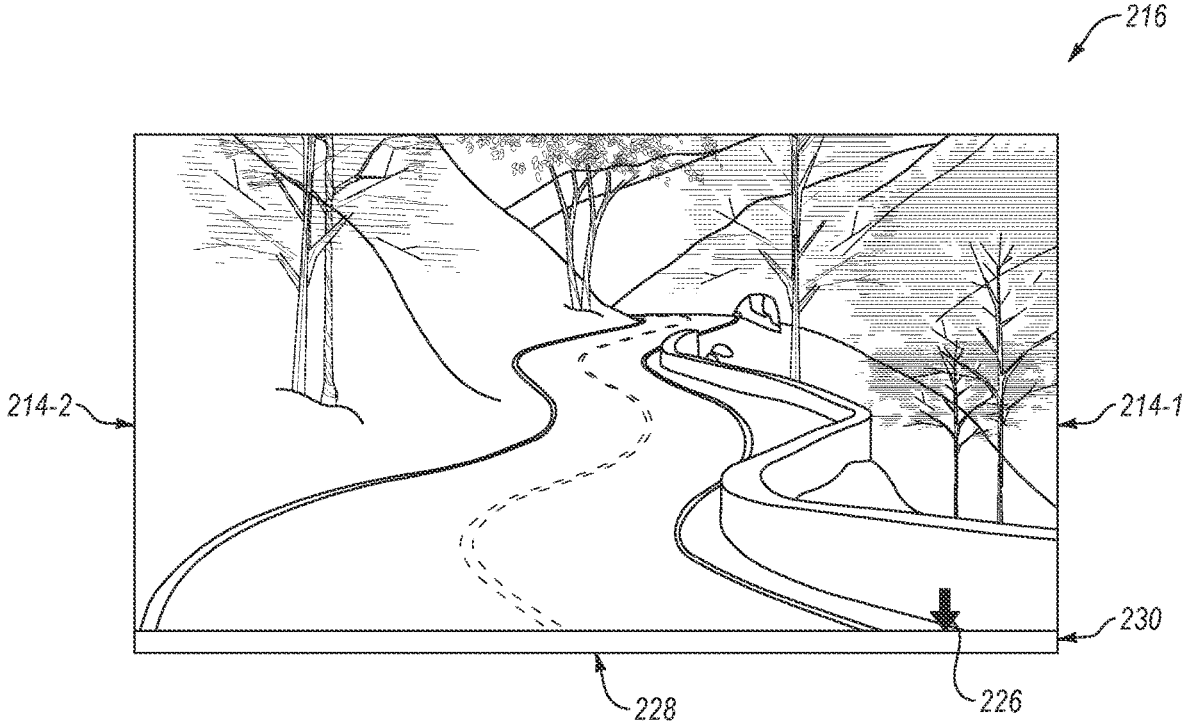
Figures 1, 3:
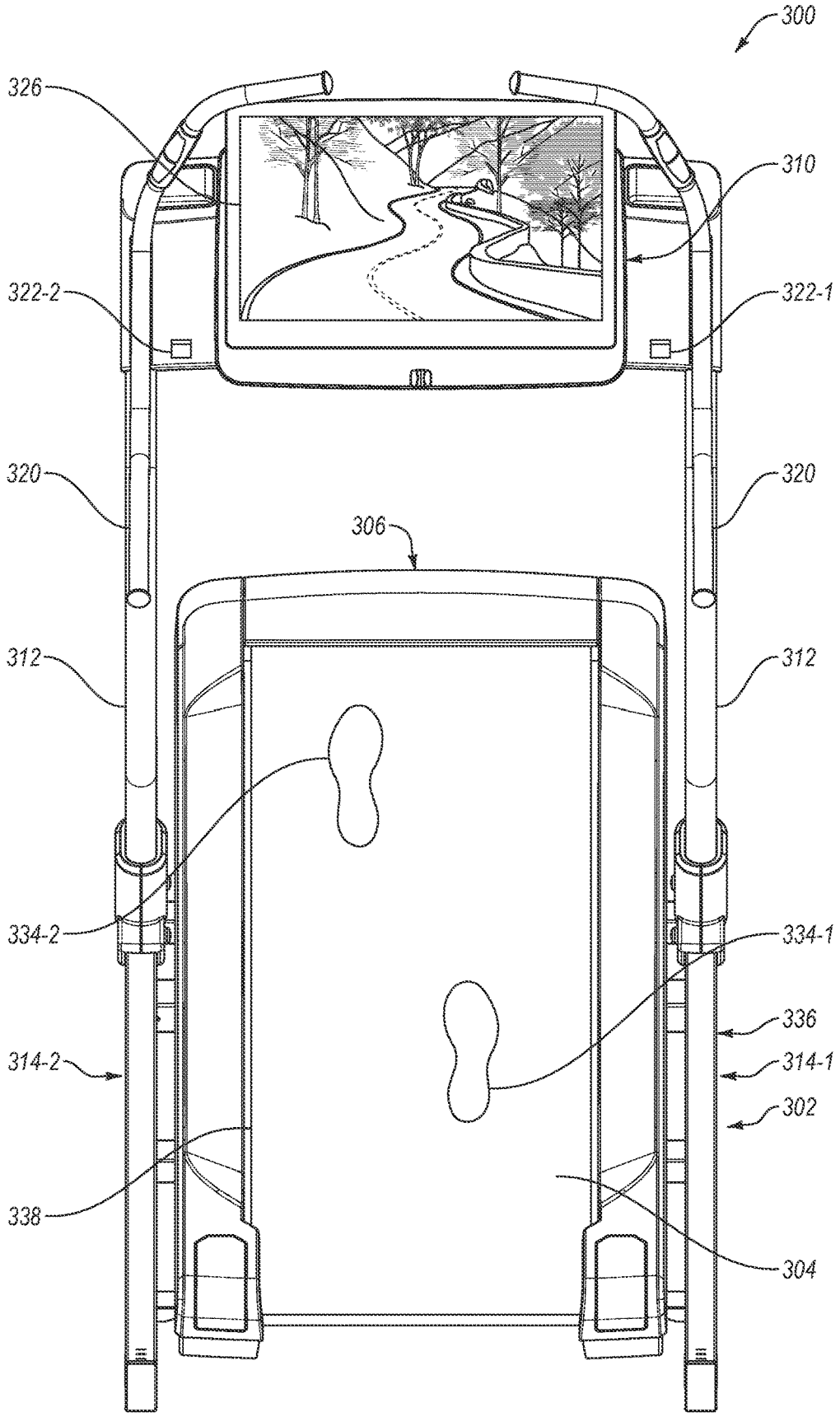
Figures 2, 3:
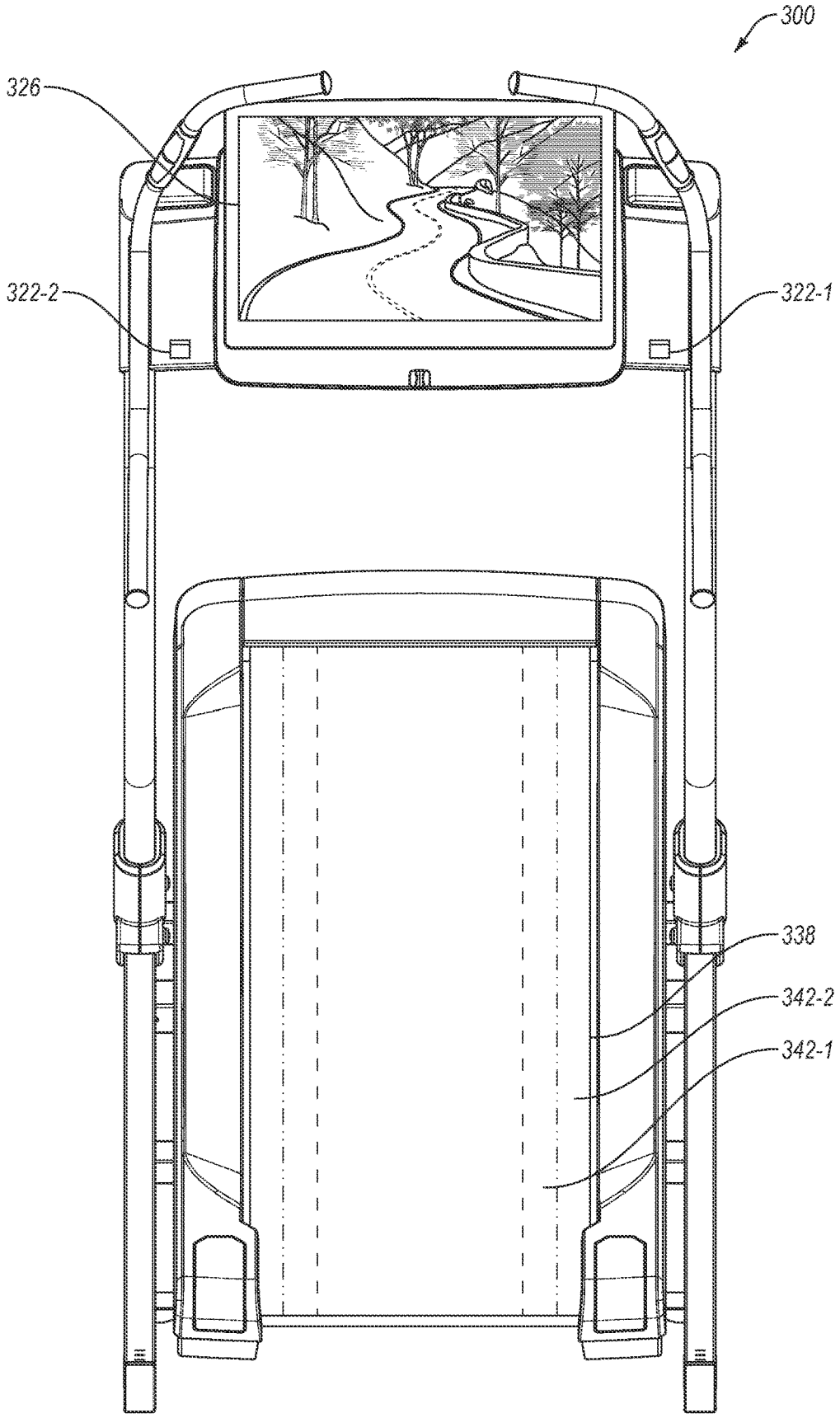
Figure 4:
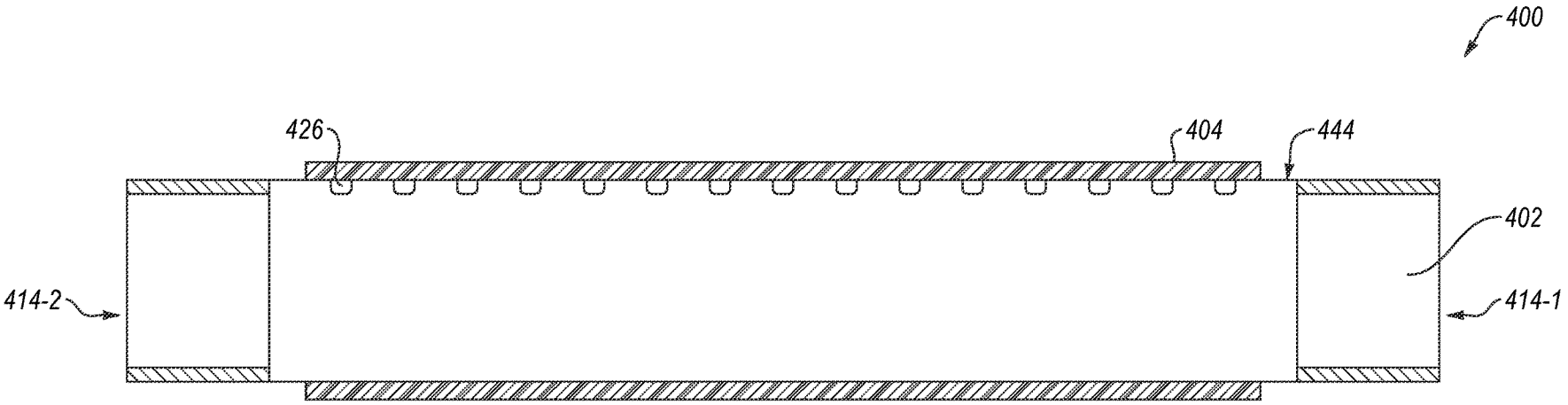
Figure 5:
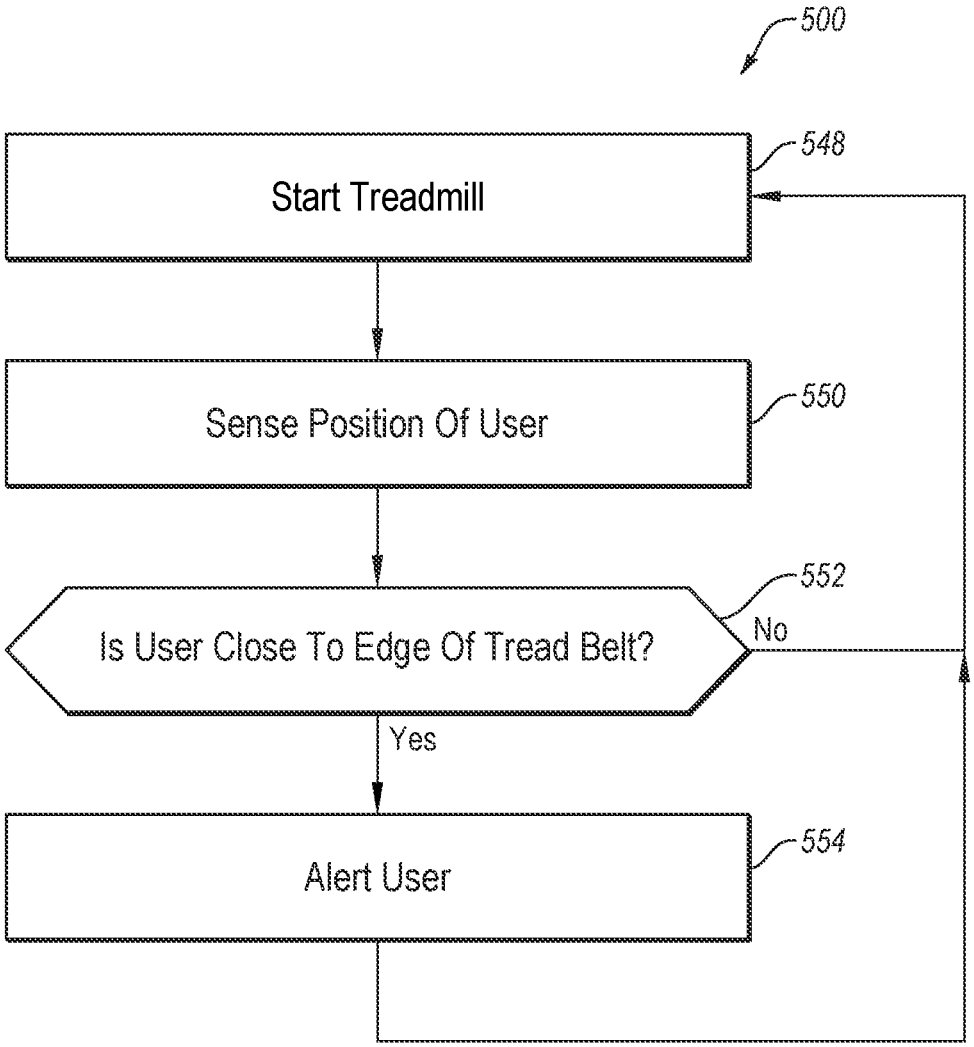
Figure 6:
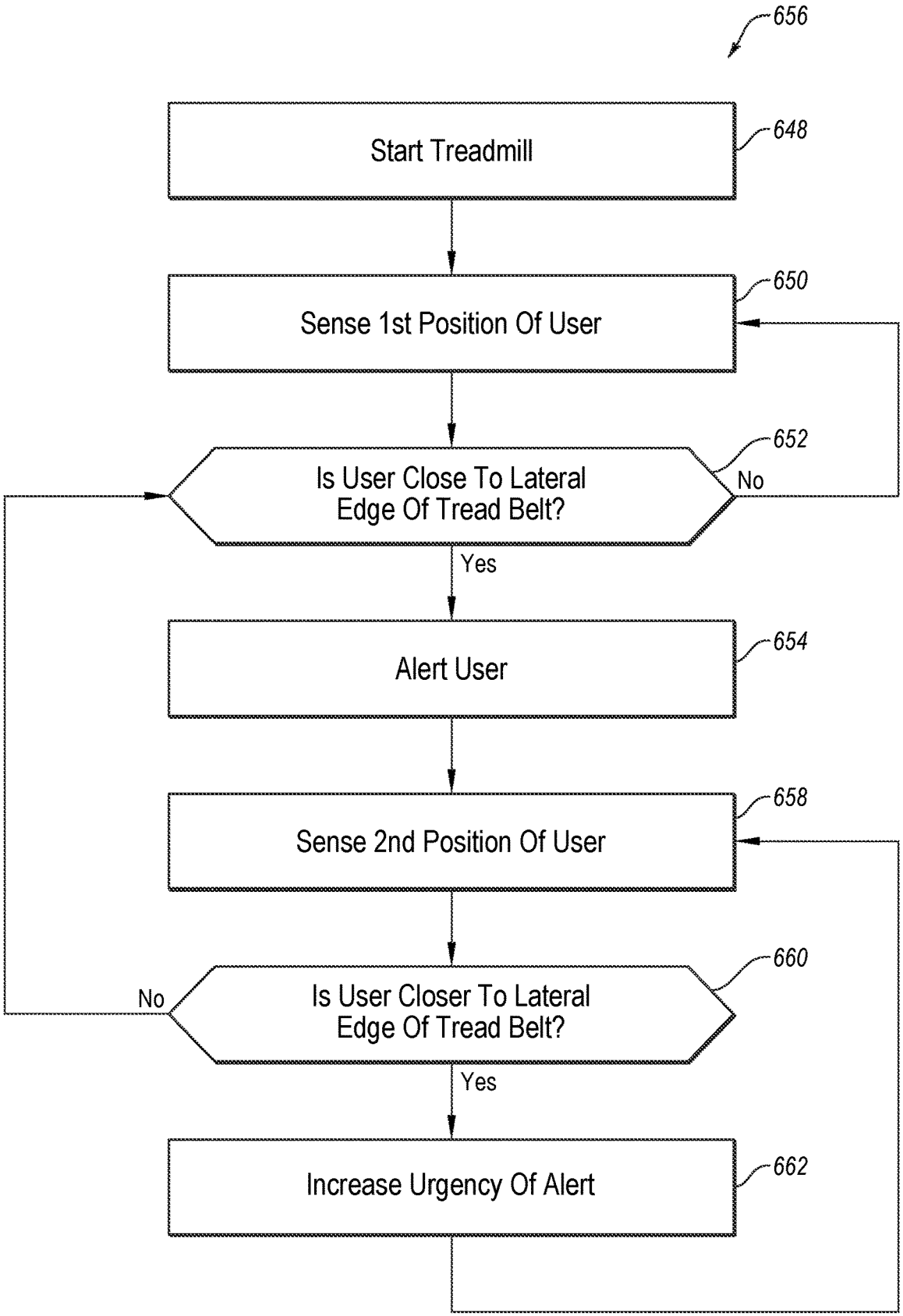

FIG. 6 is a representation of a flowchart 656 used to determine when to alert a user, according to at least one embodiment of the present disclosure. After starting the treadmill at 648, a first lateral position of the user is sensed at 650. The treadmill then determines if the user is close to the lateral edge of the tread belt at 652. If the user is not close (e.g., outside of an alert percentage, outside an alert zone) to the lateral edge of the tread belt, then the treadmill will sense the position of the user again.

If the user is close (e.g., within an alert percentage, inside an alert zone) to the lateral edge of the tread belt, then an alert is supplied to the user at 654. A second lateral position of the user is then sensed at 658. The treadmill then determines if the user is closer to the lateral edge of the tread belt relative to the most recently sensed position at 660. If the user is not closer to the lateral edge of the tread belt, then the treadmill returns to act 652 and determines if the user is close to the lateral edge of the tread belt.

If the second lateral position of the user is closer to the edge of the tread belt, then the urgency of the alert may be increased (e.g., color change, faster blinking light, greater overlay over a display) at 662. The treadmill then returns to act 658 and senses another position of the user and determines if the user is still moving closer to the edge of the tread belt. This loop may be repeated until the user is not moving closer to the edge of the tread belt. In this manner, the urgency of the alert is determined by whether the user is moving closer to the edge of the tread belt, which may help a user to know if he is drifting, and the extent to which he is drifting. The treadmill may repeatedly sense and analyze positions of the user indefinitely during the term of the workout. In other words, the logic and loops shown in FIG. 6 may be repeated indefinitely.

Figure 7:
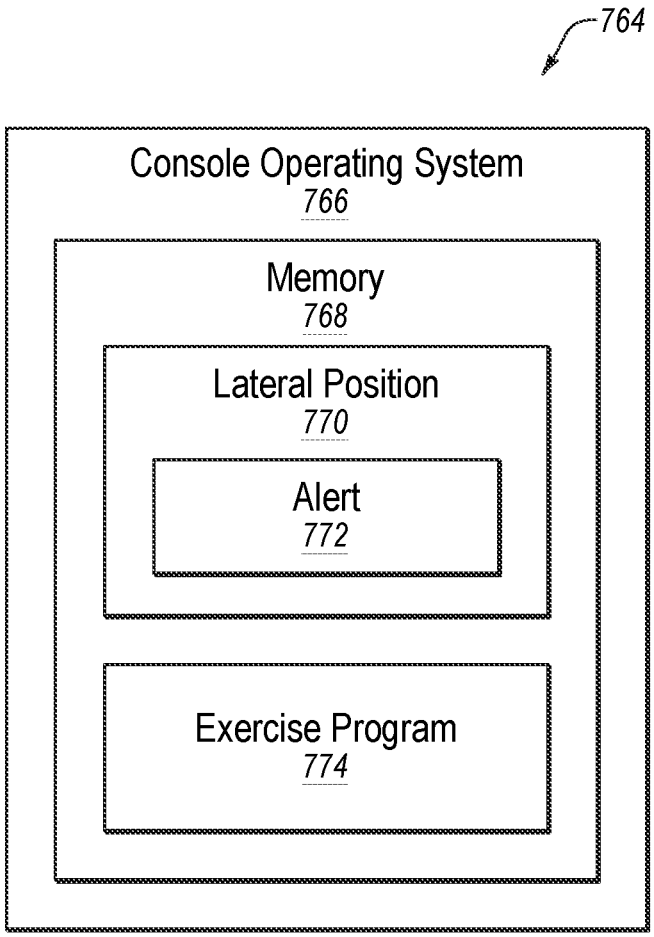
FIG. 7 is a representation of a computing system, according to at least one embodiment of the present disclosure.

FIG. 7 is a representation of a computing system 764 used to operate a treadmill, according to at least one embodiment of the present disclosure. A console operating system 766 may be run by one or more processors. The processors may include memory 768 that, when accessed by the processor, can cause the processor to perform tasks. The memory 768 may include a lateral position program 770. The lateral position program 770 may include instructions that cause a sensor to sense the lateral position of a user. If the user is close (e.g., within an alert percentage, within an alert zone) to the lateral edge of the tread belt, then an alert program 772 may alert the user. An exercise program 774 may be playing while the lateral position program 770 determines the lateral position of the user. In some embodiments, the alert interrupt the exercise program. In other words, the lateral position program may be in communication with the exercise program, and may have priority to pause, interrupt, or overlay information in the display over the exercise program.

Figure 8:
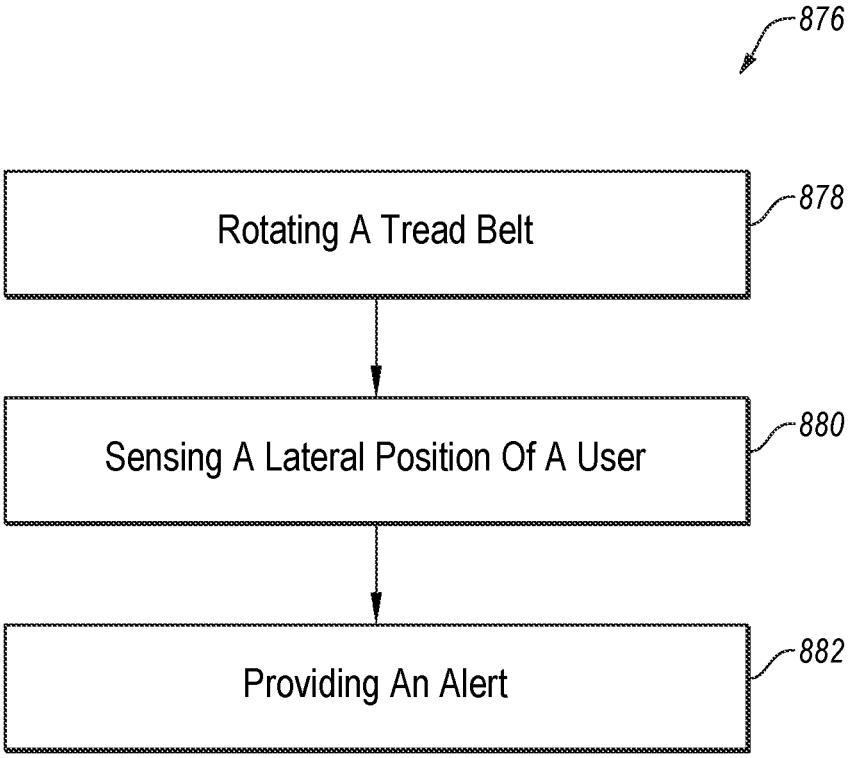
FIG. 8 is a representation of a method for operating a treadmill, according to at least one embodiment of the present disclosure.

FIG. 8 is a representation of a method 876 for operating a treadmill, according to at least one embodiment of the present disclosure. The method 876 includes rotating a tread belt at 878. The tread belt may be wrapped around a front pulley located at a front of the treadmill and a rear pulley located at a rear of the treadmill. The tread belt may rotate from the front pully to the rear pulley so that a user facing the front of the treadmill may walk forward while the tread belt is rotating.

The method 876 may further include sensing a lateral position of a user at 880. The lateral position may be sensed using a sensor, such as a motion sensor. The lateral position of the user may be the lateral position of the user relative to the lateral edges of the tread belt. For example, the lateral position may be the distance from the lateral edge of the tread belt. In some embodiments, sensing the lateral position of the user may include sensing the lateral position of a foot strike of the user.

The method 876 may further include providing an alert on a console located at the front end of the deck when the lateral position is close to the lateral edge of the tread belt at 882. For example, an alert may be provided with the lateral position of the user is within an alert zone, or within an alert percentage, or otherwise close to the lateral edge of the tread belt at 882. In some embodiments, providing the alert may include overlaying the a visual signal (e.g., a light, a flashing/blinking light, an indicator) over an exercise program. In some embodiments, the exercise program may be interrupted while providing the alert. In some embodiments, the intensity of the alert may be changed based on the distance of the user from the lateral edge of the tread belt.

Figure 9:
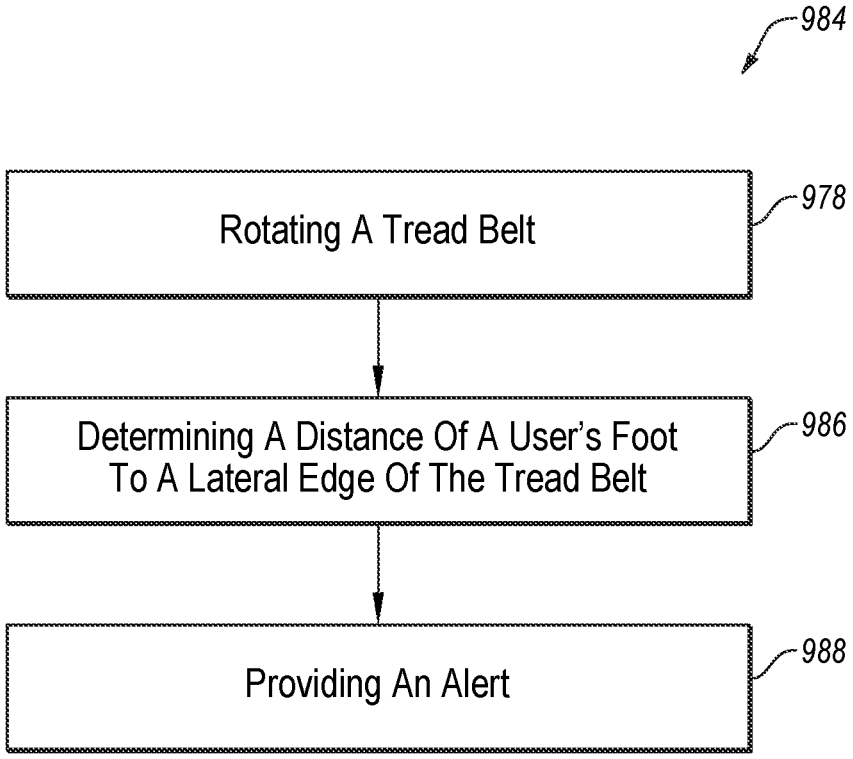
FIG. 9 is a representation of another method for operating a treadmill, according to at least one embodiment of the present disclosure.

FIG. 9 is a representation of a method 984 of operating a treadmill, according to at least one embodiment of the present disclosure. The method 984 includes rotating a tread belt at 978. The tread belt may be wrapped around a front pulley located at a front of the treadmill and a rear pulley located at a rear of the treadmill. The tread belt may rotate from the front pully to the rear pulley so that a user facing the front of the treadmill may walk forward while the tread belt is rotating.

The method 984 further includes determining a distance of a user's foot to a lateral edge of the tread belt at 986. In some embodiments, the distance may be measured from any part of the user's foot, including the inside edge, the outside edge, the center, the ball, the heal, or any other portion of the user's foot. In some embodiments, an alert may be provided on a console at the front end of the deck if the user's foot is close to the lateral edge of the tread belt at 988. In some embodiments, the alert may be provided when the distance between the user's foot and the lateral edge of the tread belt is less than an alert percentage of the distance relative to the width of the tread belt (e.g., the distance divided by the tread belt width). In some embodiments, the alert percentage may change based on a speed of the tread belt. For example, as the tread belt speed increases, the alert percentage may increase, and as the tread belt speed decreases, the alert percentage may decrease.

In some embodiments, the distance may be determined by determining a belt edge location of the lateral edge of the tread belt. A foot location of the user's foot may then be detected. The distance between the foot location and the belt edge location may then be determined.

INDUSTRIAL APPLICABILITY

This disclosure relates to devices, systems, and methods for a drift avoidance system on a treadmill. As a user walks, runs, or otherwise operates a treadmill, the user may tend to "drift," or to move laterally (e.g., to the left or to the right) on the tread belt. A sensor, such as a motion sensor, may sense the lateral position of the user. If the user drifts too far to the right or to the left, an alert (such as a light) may be displayed in a location visible to the user, such as on the console, and/or on a display of the console. This may help remind the user to stay on the tread belt. Furthermore, this may alert the user that he or she is not in the optimal safe operating position (e.g., not in the center of the tread belt).

In some embodiments, the treadmill includes an exercise deck. A tread belt extends around a portion of the exercise deck. The treadmill includes a first pulley at a front end (e.g., a first end) of the exercise deck and a second pulley at a rear end (e.g., a second end) of the exercise deck. The tread belt may extend around the first pulley and the second pulley. The tread belt may rotate around the exercise deck, supported at the front end by the first pulley and at the rear end by the second pulley. In some embodiments, one or both of the first pulley and the second pulley may be driven with a motor, which may cause the tread belt to rotate. In some embodiments, force applied by a user walking or running on the tread belt may cause the tread belt to rotate.

The treadmill includes a console. In some embodiments, the console may be located above the exercise deck at or near the front end. The tread belt may rotate such that the top portion of the tread belt may travel from the front end 106 to the rear end. In this manner, the user may face the console while walking or running on the treadmill.

In some embodiments, the console is supported by a first post and a second post. The first post is located on a first lateral side (e.g., the right side) of the exercise deck and the second post is located on a second lateral side (e.g., the left side) of the exercise deck. The console includes a display (such as a video screen, a touch screen display, or other screen). Exercise parameters, such as tread belt speed, exercise deck incline angle, biometric parameters (e.g., heartrate), may be displayed on the display. A first handle and a second handle may be connected to the console and/or the first post and the second post. While the console has been described as being supported by the first post and the second post and connected to the first handle and the second handle, it should be understood that one or more of the first post, the second post, the first handle, and the second handle may be a part of (e.g., integrated with, formed with, part of the same structure) the console.

A sensor may be located on the console. The sensor may sense the lateral position of the user. For example, the sensor may sense how close the user is to the first lateral side or to the second lateral side of the exercise deck. The sensor may be any type of sensor. For example, the sensor may be a motion detection sensor, a time-of-flight sensor, an optical sensor, a camera sensor, an infrared sensor, any other type of sensor, and combinations thereof.

In some embodiments, the console may include a plurality of sensors. For example, the console shown includes a first sensor on the first lateral side and a second sensor on the second lateral side. However, it should be understood that the plurality of sensors may be located at any location of the console, including in the center of the console or otherwise located on the console. In some embodiments, each sensor of the plurality of sensors may be the same type of sensor. In some embodiments, the plurality of sensors may include different types of sensors. For example, the first sensor may be a motion sensor and the second sensor may be a camera sensor.

In some embodiments, a first sensor located on the first lateral side may sense if the user is getting close to the first lateral side. The second sensor located on the second lateral side may sense if the user is getting close to the second lateral side. Thus, each sensor may independently sense if the user is getting close to the lateral side of the exercise deck. In some embodiments, the first sensor may sense if the user is getting close to both the first lateral side and the second lateral side. In some embodiments, the second sensor may sense if the user is getting close to both the first lateral side and the second lateral side.

If the sensor senses that the user is close to the first lateral side or the second lateral side, then an alert may be presented. For example, an indicator may indicate that the user is close to the first lateral side or the second lateral side. In some embodiments, the indicator may be a light. For example, if the sensor senses that the user is close to the first lateral side or the second lateral side, then the indicator light may flash to grab the attention of the user. In some embodiments, the indicator may be a sound. For example, if the sensor senses that the user is close to the first lateral side or the second lateral side, then the indicator may make a sound. In some embodiments, the indicator may include haptic feedback. For example, if the sensor senses that the user is close to the first lateral side or the second lateral side, then the indicator may vibrate, buzz, shake, or otherwise provide a physical indication to the user. In some embodiments, the indicator may include a combination of one or more of a light, a sound, and haptic feedback.

In some embodiments, the indicator may be located at the front end of the treadmill and/or exercise deck. For example, the indicator may be located on the console. In some embodiments, the indicator may not be located on the exercise deck. In some embodiments, the indicator may not be located on a siderail or other feature on the lateral side of the exercise deck. In some examples, the indicator may be incorporated into the display. In some embodiments, the console may include a separate light (e.g., a light bulb, LED light).

In some embodiments, an exercise video may play on the display. When the sensor senses that the user is close to the lateral edge of the exercise deck, then a portion of the display may change color. For example, the portion of the display may change to red, yellow, green, blue, purple, or any other color. In some embodiments, the indicator may be overlaid over the exercise video playing on the display. For example, the indicator may interrupt the exercise video. In some examples, the exercise program may stop (e.g., the timer and distance measurements may pause in their recordings) when the indicator is activated. In some examples, the exercise video may be visible through the indicator, and the exercise video may continue while the indicator is activated.

In some embodiments, an indicator may change based on the location of the user. For example, as the user moves closer to the lateral edge of the exercise deck, the indicator may increase in intensity (e.g., brightness, sound). In some embodiments, as the user moves closer to the lateral edge, the indicator may change in color. For example, at a first distance from the lateral edge, the indicator may show a first color (such as yellow). At a second distance from the lateral edge, the indicator may show a second color (such as red). The colors may be indications of the proximity to the lateral edge. For example, red may indicate a position that is closer to the lateral edge than yellow.

In some embodiments, the indicator may always provide an indication of the distance of the user to the lateral edge (e.g., the indicator may always be on). If the user is "safe," or located far away from the lateral edge, the indicator may be green, as the user moves toward the lateral edge, the indicator may change color from green to yellow to red (including any number of color gradations therebetween, and/or any number of additional colors).

In some embodiments, the indicator may be always on. For example, if the user is in the center of the tread belt, then the indicator may provide a positive indication, such as a green light or a low intensity light. As the user moves closer to the lateral edge of the tread belt, the indicator may change the urgency of the indication, such as by changing colors or increasing in intensity. In this manner, the user may glance at the indicator to receive an indication of her lateral location on the tread belt, without having to look down at the tread belt. This may reduce the chance that the user may fall and/or injure herself.

In some embodiments, the indicator may include a first indicator and a second indicator. The first indicator may be located on the first lateral side of the display and the second indicator may be located on the second lateral side of the display. When the sensor detects or determines that the user is close to the first lateral side, the first indicator may provide an indication (e.g., light up). Similarly, when the sensor detects or determines that the user is close to the second lateral side, the second indicator may provide an indication (e.g., light up).

In some embodiments, a display may play a video, such as an exercise video, a video of real scenery, a video of animated scenery, or other exercise video. In some embodiments, a right indicator is located on a right side of the display and a left indicator is located on a left side of the display. When the user moves close to the lateral edge of the tread belt, one or both of the indicators may light up. In some embodiments, when the user moves close to either the first lateral edge or the second lateral edge, both of the indicators may light up (e.g., independent of to which lateral edge the user is close). In some embodiments, when the user moves close to the right edge of the tread belt, the right indicator may light up. In some embodiments, when the user moves close to the left edge of the tread belt, the left indicator may light up.

In some embodiments, the indicators may light up with a constant brightness. In some embodiments, an intensity of the brightness of the indicator may be dependent on how close to the edge of the tread belt the user is. For example, as the user moves closer to the edge of the tread belt, the brightness of the indicator may increase.

In some embodiments, the indicators may pulse (e.g., blink, flash) on and off when the user moves close to the edge of the tread belt. In some embodiments, as the user moves closer to the edge of the tread belt, the speed of the pulsing may increase. In some embodiments, the color of the indicator may change based on the proximity of the user to the edge of the tread belt (e.g., green for safe, yellow for caution, and red for danger). In some embodiments, the indicators may change color and pulse as the user moves closer to the edge of the tread belt. In some embodiments, the indicators may only change color or pulse with the same color as the user moves closer to the edge of the tread belt.

In some embodiments, the indicators may overlay a portion of the display. In some embodiments, as the user moves closer to the lateral edge of the exercise deck, the overlay may change. For example, the opacity (or translucence) of the indicator may change based on the position of the user. If the user is closer to the lateral edge, the indicator may become more opaque (or less translucent), thereby increasing the urgency of the alert to the user. In some embodiments, the indicator may increase the extent of the overlay (e.g., from the right edge or the left edge) based on the distance the user is located form the lateral edge. As the user moves closer to the lateral edge, the indicator may extend further toward the center of the display, thereby making it more visible (e.g., increasing the urgency) to the user. In some embodiments, the color of the overlay may change as the user moves close to the edge of the tread belt. In some embodiments, the color and the opacity may change as the user moves close to the edge of the tread belt.

In some embodiments, the indicator may be located at a bottom edge of the display. It should be understood that the indicator may be located anywhere on the display, including the top edge, the right side, the left side, and combinations thereof The indicator may include a light that lights up based on a relative position of the user. For example, if the user is operating in the center of the tread belt, then the indicator may be lit up at the center of the bottom edge. As the user moves toward the right side or the left side of the tread belt, the indicator may light up closer toward the right side or the left side of the display. In some embodiments, the indicator may move closer to the right side or the left side based on the relative proximity of the user to the right side or the left side of the tread belt. In some embodiments, the display may include an indicator for each foot. In this manner, the user may track the position of each foot relative to the edge of the tread belt. This may help increase the safety of the user and improve the user's sense of position on the tread belt.

In some embodiments, the indicator may include an symbol representative of the relative location of the user on the tread belt. The symbol may be any symbol, including an arrow, a circle, a foot print, a shoe, a person, or any other symbol. Similar to the indicator discussed above, the indicator may move relative to the center of the bottom edge based on the relative position of the user. In some embodiments, the indicator may include a virtual representation of the treadmill on the display, and a cartoon or other symbol representing the user may be superimposed over the treadmill to indicate the user's lateral position.

In some embodiments, a treadmill includes a console located at a front end of the exercise deck. One or more sensors may be located on the console. The sensors may be configured to sense the lateral position of the user. In some embodiments, the sensors may be able to sense the lateral position of the user on the tread belt. For example, the sensors may have a line-of-sight of a portion or an entirety of the tread belt.

The sensors may be located at any location on the treadmill. For example, the sensors may be located on the console. In some embodiments, the sensors may be located on the handles, on the posts, on the tread deck, or in any other location. In some embodiments, the treadmill may include a plurality of sensors, such as a first sensor on a first lateral side of the treadmill and a second sensor on a second lateral side of the treadmill.

In some embodiments, to sense or detect the lateral position of the user, the sensors may detect the lateral location of a user's feet. For example, the sensors may detect the lateral position of a right foot and the lateral position of a left foot. In some embodiments, the lateral position may be measured relative to the outer edge of the exercise deck. In some embodiments, the lateral position may be measured relative to the lateral edge of the tread belt. In some embodiments, the lateral position may be measured relative to the center of the foot. In some embodiments, the lateral position may be measured relative to the outer edge of the foot. In some embodiments, the lateral position may be measured relative to the inner edge of the foot.

If the lateral position is close to the edge of the exercise deck or the tread belt, an indicator may alert the user. For the purposes of this disclosure, close may be any distance that provides a risk of tripping and/or falling for the user. For example, close may be measured in terms of an alert percentage of the tread belt width. For example, close may be 20%, 15%, 10%, 5%, 4%, 3%, 2%, 1%, 0.5%, 0.1%, of a width of the treadmill. When the user's foot comes within the alert percentage to the lateral edge of the tread belt and/or the exercise deck, the indicator may alert the user.

In some embodiments, the alert percentage may be set by the manufacturer, and may not be changed by the user. In some embodiments, the user may set the alert percentage, based on her use preferences. In some embodiments, the alert percentage may change based on the rotational speed of the tread belt. For example, the alert percentage may be decreased (e.g., the user may move closer to the edge of the tread belt and/or the exercise deck before receiving an alert) at slower speeds, and increased (e.g., the user may not move as close to the edge of the tread belt and/or the exercise deck before receiving an alert) at higher speeds.

In some embodiments the tread belt may move laterally (e.g., track) along the exercise deck. The sensors may sense the position of the lateral edge of the tread belt and the lateral position of the user's foot to determine the distance (e.g., the alert percentage) of the user's foot from the lateral edge of the tread belt.

In some embodiments, sensors may detect for the presence of the user (e.g., the user's foot) in an alert zone (collectively). If the user's foot (or other body part) crosses the alert zone, then the indicator may alert the user. In this manner, the sensor does not need to determine or calculate distances between the user's foot and the edge of the tread belt. The sensor can simply sense if the user enters the alert zone. For example, the sensor may be a motion sensor, and any motion within the alert zone may cause the indicator to alert the user.

In some embodiments, the treadmill may include multiple alert zones. For example, a first alert zone may be located closer to the center of the tread belt than a second alert zone. If the user enters the first alert zone, then the indicator may provide a "mild" alert (e.g., a yellow light) to the user. If the user enters the second alert zone and is therefore closer to the lateral edge of the tread belt, then the indicator may provide an "urgent" alert (e.g., a red light) to the user. In some embodiments, the treadmill may include any number of alert zones, including 1, 2, 3, 4, 5, 6, 7, 8, 9, 10, or more alert zones.

In some embodiments, an upper surface of an exercise deck includes a plurality of sensors. Thus, the sensors may be located between the exercise deck and a tread belt. In some embodiments, the sensors may be embedded in the exercise deck. The sensors may be located in a pattern across the exercise deck. In some embodiments, the sensors may be weight or pressure sensors. As the user walks or runs on the treadmill, the sensors may detect the weight of the user. The lateral location of the user may be determined or inferred by identifying which of the sensors has been triggered. Thus, if a sensor on the left lateral side is triggered, then the treadmill may know that the user is near the left lateral edge of the tread belt. An indicator may alert the user that she is close to the left lateral edge of the tread belt. Similarly, if a sensor on the right lateral side is triggered, then the treadmill may know that the user is near the right lateral edge of the tread belt. An indicator may then alert the user that she is close to the right lateral edge of the tread belt.

In some embodiment a method may be used to determine when to alert a user. After starting the treadmill, the lateral position of a user may be sensed. The treadmill then determines if the user is close to the lateral edge of the tread belt. If the user is not close (e.g., outside of an alert percentage, outside an alert zone) to the lateral edge of the tread belt, then the treadmill will sense the position of the user again. If the user is close (e.g., within an alert percentage, inside an alert zone) to the lateral edge of the tread belt, then an alert is supplied to the user. After the user is alerted, the position of the user is sensed again. This process may loop indefinitely.

In some embodiments, the position of the user may be sensed regularly, such as on a sensing interval. In some embodiments, the sensing interval may be less than 1 s, 0.9 s, 0.8 s, 0.7 s, 0.6 s, 0.5 s, 0.4 s, 0.3 s, 0.2 s, 0.1 s, 0.05 s, 0.01 s, or any value therebetween. In some embodiments, the lateral position of the user may be sensed with every footfall. It may be critical that the position of the user is sensed every footfall because the position of the user may change with every step.

In some embodiments, after starting the treadmill, a first lateral position of the user is sensed. The treadmill then determines if the user is close to the lateral edge of the tread belt. If the user is not close (e.g., outside of an alert percentage, outside an alert zone) to the lateral edge of the tread belt, then the treadmill will sense the position of the user again.

If the user is close (e.g., within an alert percentage, inside an alert zone) to the lateral edge of the tread belt, then an alert is supplied to the user. A second lateral position of the user is then sensed. The treadmill then determines if the user is closer to the lateral edge of the tread belt relative to the most recently sensed position. If the user is not closer to the lateral edge of the tread belt, then the treadmill returns to determine if the user is close to the lateral edge of the tread belt.

If the second lateral position of the user is closer to the edge of the tread belt, then the urgency of the alert may be increased (e.g., color change, faster blinking light, greater overlay over a display). The treadmill then returns to sense another position of the user and determines if the user is still moving closer to the edge of the tread belt. This loop may be repeated until the user is not moving closer to the edge of the tread belt. In this manner, the urgency of the alert is determined by whether the user is moving closer to the edge of the tread belt, which may help a user to know if he is drifting, and the extent to which he is drifting. The treadmill may repeatedly sense and analyze positions of the user indefinitely during the term of the workout. In other words, the logic and loops described may be repeated indefinitely.

In some embodiments, a computing system may be used to operate a treadmill, according to at least one embodiment of the present disclosure. A console operating system may be run by one or more processors. The processors may include memory that, when accessed by the processor, can cause the processor to perform tasks. The memory may include a lateral position program. The lateral position program may include instructions that cause a sensor to sense the lateral position of a user. If the user is close (e.g., within an alert percentage, within an alert zone) to the lateral edge of the tread belt, then an alert program may alert the user. An exercise program may be playing while the lateral position program determines the lateral position of the user. In some embodiments, the alert interrupt the exercise program. In other words, the lateral position program may be in communication with the exercise program, and may have priority to pause, interrupt, or overlay information in the display over the exercise program.

In some embodiments, a method for operating a treadmill includes rotating a tread belt. The tread belt may be wrapped around a front pulley located at a front of the treadmill and a rear pulley located at a rear of the treadmill. The tread belt may rotate from the front pulley to the rear pulley so that a user facing the front of the treadmill may walk forward while the tread belt is rotating.

The method may further include sensing a lateral position of a user. The lateral position may be sensed using a sensor, such as a motion sensor. The lateral position of the user may be the lateral position of the user relative to the lateral edges of the tread belt. For example, the lateral position may be the distance from the lateral edge of the tread belt. In some embodiments, sensing the lateral position of the user may include sensing the lateral position of a foot strike of the user.

The method may further include providing an alert on a console located at the front end of the deck when the lateral position is close to the lateral edge of the tread belt. For example, an alert may be provided with the lateral position of the user is within an alert zone, or within an alert percentage, or otherwise close to the lateral edge of the tread belt. In some embodiments, providing the alert may include overlaying the a visual signal (e.g., a light, a flashing/blinking light, an indicator) over an exercise program. In some embodiments, the exercise program may be interrupted while providing the alert. In some embodiments, the intensity of the alert may be changed based on the distance of the user from the lateral edge of the tread belt.

In some embodiments, a method for operating a treadmill includes rotating a tread belt. The tread belt may be wrapped around a front pulley located at a front of the treadmill and a rear pulley located at a rear of the treadmill. The tread belt may rotate from the front pulley to the rear pulley so that a user facing the front of the treadmill may walk forward while the tread belt is rotating.

The method further includes determining a distance of a user's foot to a lateral edge of the tread belt. In some embodiments, the distance may be measured from any part of the user's foot, including the inside edge, the outside edge, the center, the ball, the heal, or any other portion of the user's foot. In some embodiments, an alert may be provided on a console at the front end of the deck if the user's foot is close to the lateral edge of the tread belt. In some embodiments, the alert may be provided when the distance between the user's foot and the lateral edge of the tread belt is less than an alert percentage of the distance relative to the width of the tread belt (e.g., the distance divided by the tread belt width). In some embodiments, the alert percentage may change based on a speed of the tread belt. For example, as the tread belt speed increases, the alert percentage may increase, and as the tread belt speed decreases, the alert percentage may decrease.

In some embodiments, the distance may be determined by determining a belt edge location of the lateral edge of the tread belt. A foot location of the user's foot may then be detected. The distance between the foot location and the belt edge location may then be determined.

Following are sections of devices and methods for treadmills according to embodiments of the present disclosure:

1) A treadmill, comprising:
   a front end;
   a back end;
   a deck between the front end and the back end;
   a tread belt configured to travel across the deck;
   a sensor configured to detect a lateral location of a user on the tread belt; and
   a console located at the front end, the console including an indicator in communication with the sensor, wherein the indicator provides a notification on the console indicating the lateral position of the user.
2) The treadmill of section 1, wherein the indicator is located on a display of the console.
3) The treadmill of section 1 or 2, wherein the sensor is a first sensor located on a first lateral side of the deck, and further comprising a second sensor configured to detect the lateral location of the user.
4) The treadmill of any of sections 1-3, wherein the sensor is located in the deck.
5)The treadmill of any of sections 1-4, wherein the sensor is a motion sensor.
6) The treadmill of any of sections 1-5, wherein the indicator includes a flashing light.
7) The treadmill of any of sections 1-6, wherein the indicator includes a light, a color of the light being based on the lateral position of the user.
8) The treadmill of any of sections 1-7, wherein the indicator includes an audible alarm.
9) A method for operating a treadmill, comprising:
   rotating a tread belt from a front end to a rear end of a deck;
   sensing a lateral position of a user on the tread belt; and
   providing an alert on a console located at the front end of the deck when the lateral position is within a lateral alert zone of the tread belt.
10)The method of section 9, wherein providing the alert includes overlaying a visual signal over an exercise program.
11) The method of section 9 or 10, wherein providing the alert includes flashing a light on the console.
12) The method of any of sections 9-11, wherein providing the alert includes interrupting an exercise program while providing the alert.
13) The method of any of sections 9-12, wherein sensing the lateral position includes sensing a distance of a user from a lateral edge of the tread belt.
14) The method of section 13, wherein providing the alert includes changing an intensity of the alert based on the distance from the lateral edge of the tread belt.
15) The method of any of sections 9-14, wherein sensing the lateral position includes sensing the lateral position of a foot strike of a user on the tread belt.
16) A method for operating a treadmill, comprising:
   rotating a tread belt from a front end to a rear end of a deck;
   determining a distance of a user to a lateral edge of the tread belt; and
   providing an alert on a console located at the front end of the deck when the distance is within an alert percentage of a width of the tread belt.

17) The method of section 16, wherein the alert percentage changes based on a speed of the tread belt.

18) The method of section 16 or 17, wherein the distance is measured from an outside of the user's foot.

19) The method of any of sections 16-18, wherein determining the distance includes:

determining a belt edge location of the lateral edge of the tread belt; determining a foot location of a foot of the user; and determining the distance between the foot location and the belt edge location.

20) The method of any of sections 16-19, wherein the distance is a first distance and the alert is a first alert, and further comprising:

determining a second distance of the user to the lateral edge of the tread belt;

if the second distance is greater than the first distance, then providing a second alert, the second alert having an increased urgency relative to the first alert.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A treadmill, comprising:

a front end;

a back end;

a deck between the front end and the back end;

a tread belt configured to travel across the deck;

a sensor configured to detect a lateral location of a user on the tread belt; and a console located at the front end, the console including a display configured to play a video, the console displaying an indicator in communication with the sensor, wherein the indicator provides a notification on the console indicating the lateral location of the user, the indicator overlaying a portion of the display, the indicator overlaying more of the display based on an urgency of the indicator, wherein the indicator extends from an edge of the display toward a center of the display, wherein the indicator increases in opacity based on the urgency of the indicator.

2. The treadmill of claim 1, wherein the sensor is a first sensor located on a first lateral side of the deck, and further comprising a second sensor configured to detect the lateral location of the user.

3. The treadmill of claim 1, wherein the sensor is located in the deck.

4. The treadmill of claim 1, wherein the indicator includes a light, a color of the light being based on the lateral location of the user.

5. The treadmill of claim 1, wherein the console further presents an audible alarm with the indicator.

6. The treadmill of claim 1, wherein the urgency changes based on a speed of the tread belt.

7. The treadmill of claim 1, wherein the indicator extends further toward the center of the display based on the urgency of the indicator.

8. The treadmill of claim 1, wherein the indicator extends further toward the center of the display as the user moves further away from a centerline of the treadmill.

9. A method for operating a treadmill, comprising:

rotating a tread belt from a front end to a rear end of a deck;

determining a distance of a user to a lateral edge of the tread belt; and providing an alert on a console located at the front end of the deck when the distance is within an alert percentage of a width of the tread belt, providing the alert including overlaying a visual signal over a video on a display, the visual signal overlaying more of the display based on an urgency of the visual signal, the urgency based on the alert percentage, wherein the alert percentage changes based on a speed of the tread belt.

10. The method of claim 9, wherein the distance is measured from an outside of the user's foot.

11. The method of claim 9, wherein determining the distance includes:

determining a belt edge location of the lateral edge of the tread belt;

determining a foot location of a foot of the user; and determining the distance between the foot location and the belt edge location.

12. The method of claim 9, wherein the distance is a first distance and the alert is a first alert, and further comprising:

determining a second distance of the user to the lateral edge of the tread belt; and if the second distance is greater than the first distance, then providing a second alert, the second alert having an increased urgency relative to the first alert.

13. A treadmill, comprising:

a front end;

a back end;

a deck between the front end and the back end;

a tread belt configured to travel across the deck;

a sensor configured to detect a lateral location of a user on the tread belt; and a console located at the front end, the console including a display configured to play a video, the console displaying an indicator in communication with the sensor, wherein the indicator provides a notification on the console indicating the lateral location of the user, the indicator overlaying a portion of the display, the indicator overlaying more of the display based on an urgency of the indicator, wherein the indicator extends from an edge of the display toward a center of the display, wherein the indicator extends further toward the center of the display based on the urgency of the indicator.

14. The treadmill of claim 13, wherein the urgency changes based on a speed of the tread belt.

15. The treadmill of claim 13, wherein the indicator increases in opacity based on the urgency of the indicator.

16. The treadmill of claim 13, wherein the indicator extends further toward the center of the display as the user moves further away from a centerline of the treadmill.

17. A treadmill, comprising:

a front end;

a back end;

a deck between the front end and the back end;

a tread belt configured to travel across the deck;

a sensor configured to detect a lateral location of a user on the tread belt; and a console located at the front end, the console including a display configured to play a video, the console displaying an indicator in communication with the sensor, wherein the indicator provides a notification on the console indicating the lateral location of the user, the indicator overlaying a portion of the display, the indicator overlaying more of the display based on an urgency of the indicator, wherein the indicator extends from an edge of the display toward a center of the display based on the urgency, wherein the urgency increases and the indicator extends further toward the center of the display as the user moves further away from a centerline of the treadmill.

18. The treadmill of claim 17, wherein the urgency changes based on a speed of the tread belt.

19. The treadmill of claim 17, wherein the indicator increases in opacity based on the urgency of the indicator.

* * * * *